US010323425B2

(12) United States Patent
Itagaki et al.

(10) Patent No.: US 10,323,425 B2
(45) Date of Patent: Jun. 18, 2019

(54) BINDING MACHINE

(71) Applicant: MAX CO., LTD., Chuo-ku, Tokyo (JP)

(72) Inventors: Osamu Itagaki, Tokyo (JP); Takahiro Nagaoka, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 15/847,654

(22) Filed: Dec. 19, 2017

(65) Prior Publication Data

US 2018/0187431 A1 Jul. 5, 2018

(30) Foreign Application Priority Data

Dec. 29, 2016 (JP) ..... 2016-257454

(51) Int. Cl.
*E04G 21/12* (2006.01)
*B21F 23/00* (2006.01)
*B65B 13/28* (2006.01)

(52) U.S. Cl.
CPC ..... *E04G 21/123* (2013.01); *B21F 23/005* (2013.01); *B65B 13/285* (2013.01)

(58) Field of Classification Search
CPC ..... B65B 13/025; B65B 13/027; B65B 13/28; B65B 13/285; B65B 13/22; B65H 59/04; E04G 21/122; B21F 9/02; B21F 15/00; B21F 15/02; B21F 23/00; B21F 23/005; B21F 33/00; B21F 15/04
See application file for complete search history.

(56) References Cited

U.S. PATENT DOCUMENTS 8,127,803 B2 * 3/2012 Kusakari ..... E04G 21/122 140/123.6
2005/0005991 A1 1/2005 Ishikawa et al.
2012/0132312 A1 5/2012 Lamb
2016/0031575 A1 * 2/2016 Shindou ..... B65B 13/025 100/25

FOREIGN PATENT DOCUMENTS

JP 10-250708 A 9/1998
JP 4747463 B2 8/2011

OTHER PUBLICATIONS

Extended European Search Report dated Feb. 2, 2018 in corresponding EP Patent Application No. 17208783.5 (7 pages).

* cited by examiner

*Primary Examiner* — Pradeep C Battula
(74) *Attorney, Agent, or Firm* — Rothwell, Figg, Ernst & Manbeck, P.C.

(57) ABSTRACT

A binding machine includes a first guide having an introduction part into which the wire to be fed by the wire feeding unit is to be introduced, and configured to curl the wire introduced from the introduction part, a second guide configured to guide the wire delivered from the first guide toward the binding unit, a main body part having one end portion at which the first guide and the second guide are provided, and, an entry regulation part provided in the main body part, provided at one side of the introduction part of the first guide at a downstream side of the binding unit with respect to a feeding direction of the wire to be fed toward the first guide by the wire feeding unit, and configured to prevent the wire from entering into one side of the introduction part of the first guide.

6 Claims, 18 Drawing Sheets

BINDING MACHINE

CROSS-REFERENCE TO RELATED APPLICATION

This application claims the priority from Japanese Patent Application No. 2016-257454 filed on Dec. 29, 2016, the entire contents of which are incorporated herein by reference.

FIELD

The present disclosure relates to a binding machine configured to bind an object to be bound such as a reinforcing bar with a wire.

BACKGROUND

In the related art, a binding machine called as a reinforcing bar binding machine configured to wind a wire on two or more reinforcing bars, and to bind the two or more reinforcing bars with the wire by twisting the wire wound on the reinforcing bars has been suggested.

The binding machine is configured to wind the wire, which is fed by a drive force of a motor, around the reinforcing bars by passing the wire through a curling member called as a curl guide or the like configured to curl the wire. The wire wound on the reinforcing bars is twisted, so that the reinforcing bars are bound with the wire.

In the related art, a binding machine configured to feed a wire in a forward direction, to wind the wire around reinforcing bars, to wind the wire on the reinforcing bars by feeding the wire in a reverse direction, to twist the wire wound on the reinforcing bars, and to bind the reinforcing bars with the wire has been suggested (for example, refer to Japanese Patent No. 4,747,463B).

The binding machine includes a retraction mechanism configured to retract a guide and the like on a moving path of the reinforcing bars during the operation of winding the wire on the reinforcing bars.

In the binding machine, when the wire is fed at a state where the reinforcing bars are not located at correct positions, a tip end of the wire is in contact with the reinforcing bars, and it is not possible to feed the wire beyond the reinforcing bars.

When the wire is continuously fed at a state where the wire cannot be normally fed, it is not possible to perform the feeding operation, the wire deviates from a feeding path and is bent, which is referred to as buckled. In particular, when the buckled wire is caught at a narrow place, it is difficult to remove the remaining wire.

When the buckled wire enters into a moveable area of a retraction mechanism of a guide and the like, it is more difficult to remove the remaining wire after being caught.

The present disclosure has been made in view of the above situations, and an object thereof is to provide a binding machine capable of securely removing a wire even when the wire deviates from a feeding path and is buckled.

In order to accomplish the above object, the present disclosure provides a binding machine including a wire feeding unit configured to feed a wire to be wound on an object to be bound, a binding unit configured to twist the wire wound on the object to be bound, a first guide having an introduction part in which the wire to be fed by the wire feeding unit is to be introduced, and configured to curl the wire introduced from the introduction part, an inductive guide configured to guide the wire delivered from the first guide toward the binding unit, a main body part having one end portion at which the first guide and the inductive guide are provided, and an entry regulation part provided at one side of the introduction part of the first guide at a downstream side of the binding unit with respect to a feeding direction of the wire to be fed toward the first guide by the wire feeding unit, in the main body part, and configured to prevent the wire from entering into one side of the introduction part of the first guide.

According to the present disclosure, even when the wire deviates from the predetermined feeding path because the wire cannot be normally fed, for example, it is possible to prevent the wire from entering into an area in the main body part in which the entry of the wire should be prevented. Thereby, it is possible to easily discharge the wire that cannot be used for the normal binding operation and remains in an operation space.

DETAILED DESCRIPTION

Hereinafter, an example of a reinforcing bar binding machine, which is an embodiment of the binding machine of the present disclosure, will be described with reference to the drawings.

<Example of Configuration of Reinforcing Bar Binding Machine of Embodiment>

Figure 1:
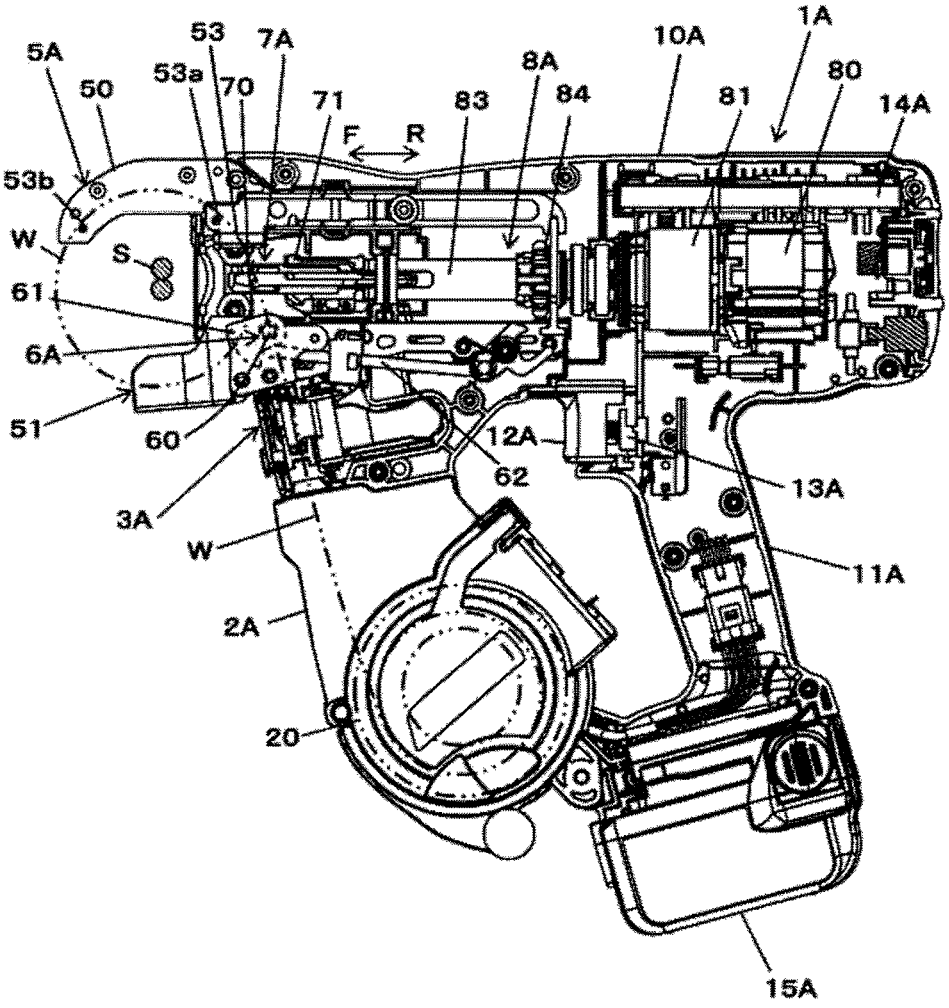
FIG. 1 is a view depicting an example of an entire configuration of a reinforcing bar binding machine of an embodiment, as seen from a side.
Figure 2:
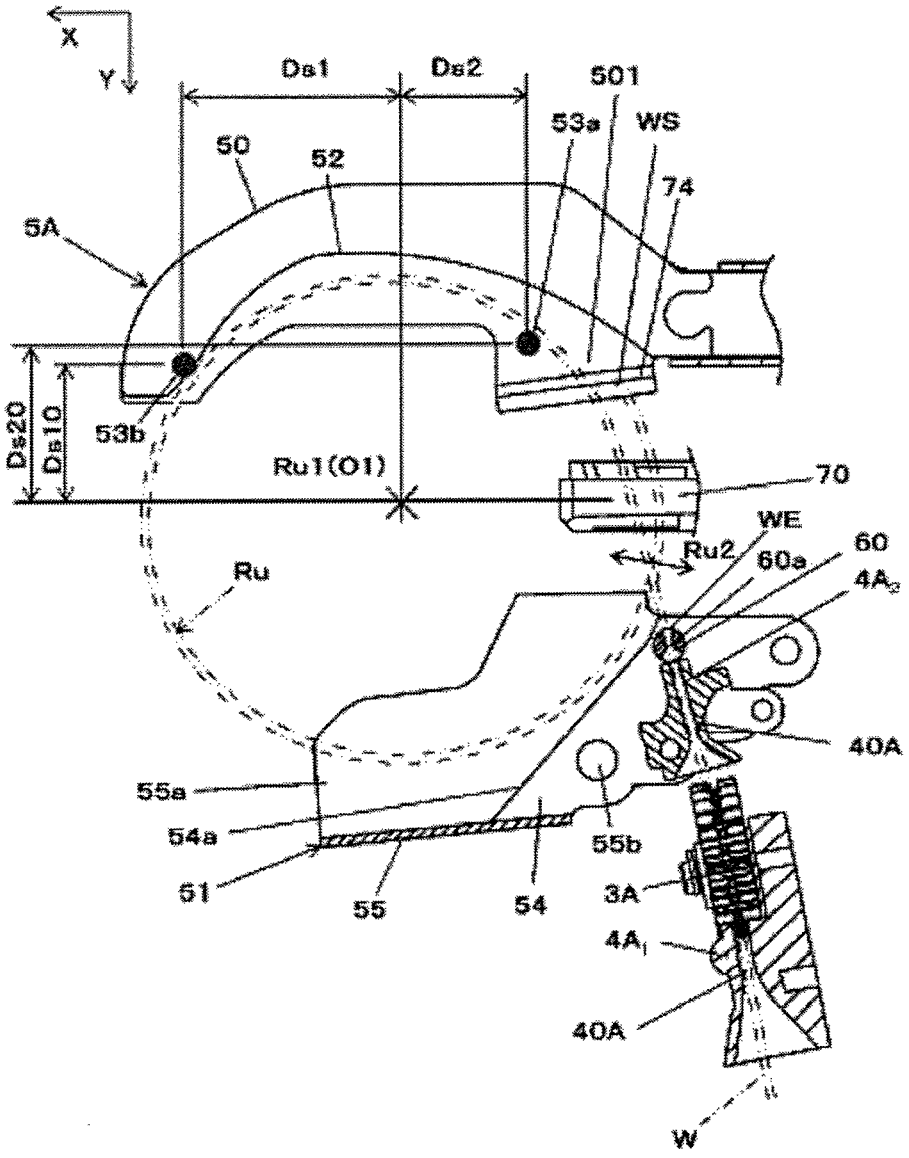
FIG. 2 is a view depicting an example of a main configuration of the reinforcing bar binding machine of the embodiment, as seen from a side.

FIG. 1 is a view depicting an example of an entire configuration of a reinforcing bar binding machine of an embodiment, as seen from a side, and FIG. 2 is a view depicting an example of a main configuration of the reinforcing bar binding machine of the embodiment, as seen from a side.

A reinforcing bar binding machine 1A of an embodiment is configured to feed wire W in a forward direction, which is one direction, to wind the wires around reinforcing bars S, which are an object to be bound, to feed the wire wound around the reinforcing bars S in a reverse direction, which is the other direction, to wind the wires on the reinforcing bars S, and to twist the wire W, thereby binding the reinforcing bars S with the wire W.

To this end, the reinforcing bar binding machine 1A includes a magazine 2A, which is an accommodation unit configured to accommodate therein the wire W, and a wire feeding unit 3A configured to feed the wire W. Also, the reinforcing bar binding machine 1A includes a first wire guide $\mathbf{4}A_1$ configured to guide the wire W, which is to be fed into the wire feeding unit 3A, and a second wire guide $\mathbf{4}A_2$ configured to guide the wire W, which is to be delivered from the wire feeding unit 3A.

Also, the reinforcing bar binding machine 1A includes a curl guide unit 5A configured to form a path along which the wire W fed by the wire feeding unit 3A are to be wound around the reinforcing bars S, and a cutting unit 6A configured to cut the wire W wound on the reinforcing bars S. Also, the reinforcing bar binding machine 1A includes a binding unit 7A configured to twist the wire W wound on the reinforcing bars S.

The magazine 2A is an example a reel accommodation unit, and a reel 20 on which the long wire W is wound to be reeled out is rotatably and detachably accommodated therein. In the reinforcing bar binding machine 1A of the embodiment, the two wires W are wound to be reeled out on the reel 20 so that the reinforcing bars S can be bound with the twos wire W.

A wire made of a plastically deformable metal wire, a wire having a metal wire covered with a resin, a twisted wire or the like can be used as the wire W.

Figure 3:
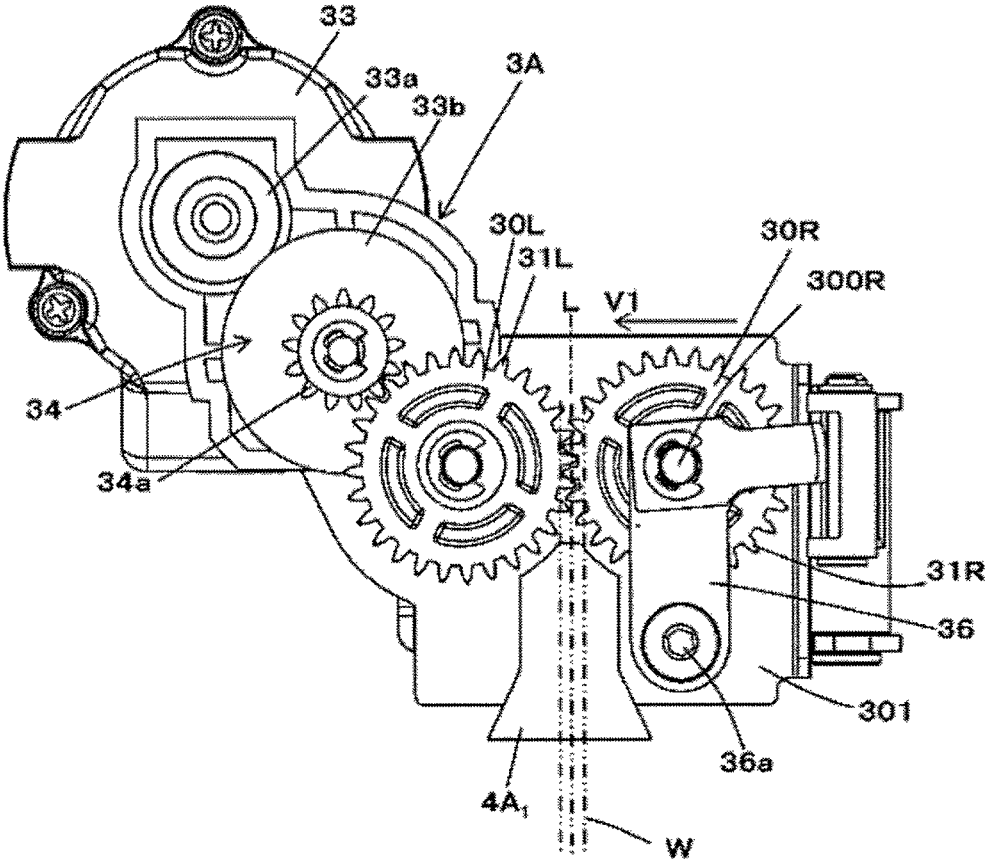
FIG. 3 is a view depicting an example of a wire feeding unit.
Figure 4:
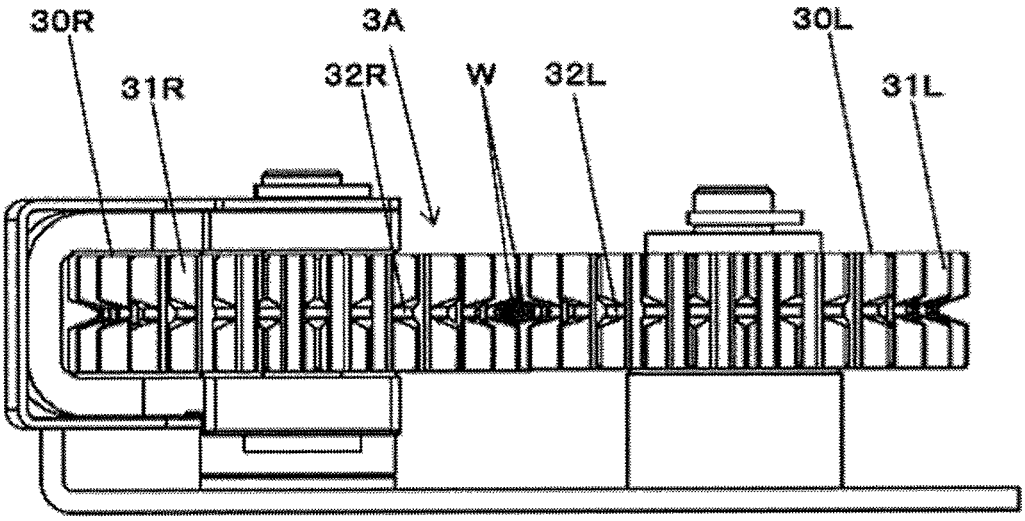
FIG. 4 is a view depicting the example of the wire feeding unit.

FIGS. 3 and 4 depict an example of the wire feeding unit. Subsequently, a configuration of the wire feeding unit 3A is described. The wire feeding unit 3A includes, a first feeding gear 30L and a second feeding gear 30R configured to feed the wire W by a rotating operation. The first feeding gear 30L and the second feeding gear 30R are a pair of feeding members configured to sandwich and feed two wires W aligned in parallel.

The first feeding gear 30L has a tooth part 31L configured to transmit a drive force. In this example, the tooth part 31L has a spur gear shape, and is formed on an entire circumference of an outer periphery of the first feeding gear 30L. Also, the first feeding gear 30L has a groove portion 32L into which the wire W enters. In this example, the groove portion 32L is a concave portion of which a sectional shape is a substantial V shape, and is formed on the entire circumference of the outer periphery of the first feeding gear 30L along a circumferential direction.

The second feeding gear 30R has a tooth part 31R configured to transmit a drive force. In this example, the tooth part 31R has a spur gear shape, and is formed on an entire circumference of an outer periphery of the second feeding gear 30R. Also, the second feeding gear 30R has a groove portion 32R into which the wire W enters. In this example, the groove portion 32R is a concave portion of which a sectional shape is a substantial V shape, and is formed on the entire circumference of the outer periphery of the second feeding gear 30R along a circumferential direction.

The first feeding gear 30L and the second feeding gear 30R are provided with the feeding path of the wire W being interposed therebetween so that the groove portion 32L and the groove portion 32R are arranged to face each other.

The first feeding gear 30L and the second feeding gear 30R are pressed so that the first feeding gear 30L and the second feeding gear 30R come close to each other so as to sandwich the wire W therebetween. Thereby, the wire feeding unit 3A sandwiches the wire W between the groove portion 32L of the first feeding gear 30L and the groove portion 32R of the second feeding gear 30R.

Therefore, the wire feeding unit 3A includes a displacement member 36 configured to displace the second feeding gear 30R in directions of coming close to and separating from the first feeding gear 30L. The second feeding gear 30R is rotatably supported to one end portion of the displacement member 36 by a shaft 300R. Also, the displacement member 36 is supported at the other end portion to a support member 301 of the wire feeding unit 3A so that the displacement member can rotate about a shaft 36*a*, which is a support point.

The displacement member 36 is configured to be pressed by a spring (not shown) and to be displaced in an arrow V1 direction by a rotating operation about the shaft 36*a*, which is a support point. Thereby, the second feeding gear 30R is pressed toward the first feeding gear 30L by a force of a spring 38.

When the wire W is mounted between the first feeding gear 30L and the second feeding gear 30R, the wire W is sandwiched by the groove portion 32L of the first feeding gear 30L and the groove portion 32R of the second feeding gear 30R.

Also, at a state where the wire W is sandwiched between the groove portion 32L of the first feeding gear 30L and the groove portion 32R of the second feeding gear 30R, the tooth part 31L of the first feeding gear 30L and the tooth part 31R of the second feeding gear 30R are meshed with each other. Thereby, the drive force is transmitted between the first feeding gear 30L and the second feeding gear 30R by rotation.

The wire feeding unit 3A includes a feeding motor 33 and a drive force transmission mechanism 34 configured to transmit a drive force of the feeding motor 33 to the first feeding gear 30L.

The feeding motor 33 is an example of the prime mover configured to drive one of the first feeding gear 30L and the second feeding gear 30R. In this example, the feeding motor 33 is configured to drive the first feeding gear 30L.

The drive force transmission mechanism 34 is an example of a motor drive force transmission part. The drive force transmission mechanism 34 includes a small gear 33*a* mounted to a shaft of the feeding motor 33 and a large gear 33*b* configured to mesh with the small gear 33*a*. Also, the drive force transmission mechanism 34 includes a feeding small gear 34*a*, which the drive force is transmitted thereto from the large gear 33*b* and is configured to mesh with the first feeding gear 30L. The small gear 33*a*, the large gear 33*b* and the feeding small gear 34*a* are respectively configured by a spur gear.

The first feeding gear 30L is configured to rotate as a rotating operation of the feeding motor 33 is transmitted thereto via the drive force transmission mechanism 34. The second feeding gear 30R is configured to rotate in conjunction with the first feeding gear 30L as a rotating operation of the first feeding gear 30L is transmitted thereto through engagement between the tooth part 31L and the tooth part 31R.

Thereby, the wire feeding unit 3A is configured to feed the wire W sandwiched between the first feeding gear 30L and the second feeding gear 30R along the extension direction of the wire W. In the configuration of feeding the two wires W, the two wires W are fed with being aligned in parallel by a frictional force that is to be generated between the groove portion 32L of the first feeding gear 30L and one wire W, a frictional force that is to be generated between the groove portion 32R of the second feeding gear 30R and the other wire W, and a frictional force that is to be generated between one wire W and the other wire W.

The wire feeding unit 3A is configured so that the rotation directions of the first feeding gear 30L and the second feeding gear 30R are switched and the feeding direction of the wire W is switched between the forward and reverse directions by switching the rotation direction of the feeding motor 33 between the forward and reverse directions.

Subsequently, the wire guide configured to guide the feeding of the wire W is described. As shown in FIG. 2, the first wire guide 4$A_1$ is arranged upstream of the first feeding gear 30L and the second feeding gear 30R with respect to the feeding direction of the wire W to be fed in the forward direction. Also, the second wire guide 4$A_2$ is arranged downstream of the first feeding gear 30L and the second feeding gear 30R with respect to the feeding direction of the wire W to be fed in the forward direction.

The first wire guide 4$A_1$ and the second wire guide 4$A_2$ have a guide hole 40A through which the wire W is to pass, respectively. The guide hole 40A has a shape for regulating a radial position of the wire W. In the configuration of feeding the two wires W, the first wire guide 4$A_1$ and the second wire guide 4$A_2$ are respectively formed with the guide hole 40A having a shape through which the two wires W are to pass with being aligned in parallel.

The guide hole 40A of the first wire guide 4$A_1$ and the second wire guide 4$A_2$ is provided on a feeding path L of the wire W to pass between the first feeding gear 30L and the second feeding gear 30R. The first wire guide 4$A_1$ is configured to guide the wire W to pass through the guide hole 40A to the feeding path L between the first feeding gear 30L and the second feeding gear 30R.

A wire introduction part, respectively, which is provided upstream of the guide hole 40A with respect to the feeding direction of the wire W to be fed in the forward direction, has a tapered shape of which an opening area is larger at an upstream side than a downstream side, such as a conical shape, a pyramid shape or the like. Thereby, the wire W can be easily introduced into the first wire guide 4$A_1$ and the second wire guide 4$A_2$.

Subsequently, the curl guide unit 5A configured to form the feeding path of the wire W along which the wire W is to be wound around the reinforcing bars S is described. The curl guide unit 5A includes a curl guide 50 (first guide) configured to curl the wire W, which is being fed by the first feeding gear 30L and the second feeding gear 30R, and an inductive guide 51 (second guide) configured to guide the wire W delivered from the first guide 50 toward the binding unit 7A.

The first guide 50 has a guide groove 52 configuring the feeding path of the wire W, and a first guide pin 53*a* and a second guide pin 53*b* serving as a guide member for curling the wire W in cooperation with the guide groove 52.

The first guide pin 53*a* is an example of the guide member and is provided at an introduction part 501-side of the first guide 50, to which the wire W being fed by the first feeding gear 30L and the second feeding gear 30R are introduced, and is arranged at a radially inner side of a loop Ru to be formed by the wire W with respect to the feeding path of the wire W configured by the guide groove 52. The first guide pin 53*a* is configured to regulate the feeding path of the wire W so that the wire W being fed along the guide groove 52 do not enter the radially inner side of the loop Ru to be formed by the wire W.

The second guide pin 53*b* is provided at a discharge part-side of the first guide 50, from which the wire W being fed by the first feeding gear 30L and the second feeding gear 30R are discharged, and is arranged at a radially outer side of the loop Ru to be formed by the wire W with respect to the feeding path of the wire W configured by the guide groove 52.

The curl guide unit 5A includes a retraction mechanism 53 configured to retract the first guide pin 53*a*. The retraction mechanism 53 is configured to be displaced in conjunction with the operation of the binding unit 7A after the wire W is wound around the reinforcing bars S, and to retract the first guide pin 53*a* from a moving path of the wire W before the wire W is wound on the reinforcing bars S.

The second guide 51 has a third guide part 54 configured to regulate a radial position of the loop Ru, which is formed by the wire W to be wound around the reinforcing bars S, and a fourth guide part 55 configured to regulate a position along an axial direction Ru1 of the loop Ru, which is formed by the wire W to be wound around the reinforcing bars S.

The third guide part 54 has a wall surface 54*a* that is provided at a radially outer side of the loop Ru, which is formed by the wire W to be wound around the reinforcing bars S, and is configured by a surface extending along the feeding direction of the wire W. When the wire W is wound around the reinforcing bars S, the third guide part 54 regulates a radial position of the loop Ru, which is formed by the wire W to be wound around the reinforcing bars S, by the wall surface 54*a*.

The fourth guide part 55 is provided at an introduction-side of the wire W and has wall surfaces 55*a* that are provided at both sides in the axial direction Ru1 of the loop Ru, which is formed by the wire W to be wound around the reinforcing bars S, and are configured by surfaces erecting from the wall surface 54*a* toward the radially inner side of the loop Ru. When the wire W is wound around the reinforcing bars S, the fourth guide part 55 regulates a position along the axial direction Ru1 of the loop Ru, which is formed by the wire W to be wound around the reinforcing bars S, by the wall surfaces 55*a*.

Thereby, the wire W delivered from the first guide 50 is guided to the third guide part 54 by the fourth guide part 55 while a position of the axial direction Ru1 of the loop Ru to be formed around the reinforcing bars S is regulated by the wall surfaces 55*a* of the fourth guide part 55.

In this example, the second guide 51 is supported to the third guide part 54 at a state where the third guide part 54 is fixed to a main body part 10A of the reinforcing bar binding machine 1A and the fourth guide part 55 can rotate about a shaft 55*b*, which is a support point. The fourth guide part 55 is configured so that an introduction-side, to which the wire W delivered from the first guide 50 is to be introduced, can be opened and closed in directions of separating from and coming close to the first guide 50. Thereby, after binding the reinforcing bars S with the wire W, the fourth guide part 55 is retracted during an operation of pulling out the reinforcing bar binding machine 1A from the reinforcing bars S, so that it possible to easily perform the operation of pulling out the reinforcing bar binding machine 1A from the reinforcing bars S.

Subsequently, the configuration of curling the wire W is described. The wire W that is fed by the first feeding gear 30L and the second feeding gear 30R are curled as the radial position of the loop Ru to be formed by the wire W is regulated at least at three points of two points of the radially outer side of the loop Ru formed by the wire W and one point of the radially inner side between the two points.

In this example, a radially outer position of the loop Ru to be formed by the wire W is regulated at two points of the second wire guide $4A_2$ provided upstream of the first guide pin 53*a* and the second guide pin 53*b* provided downstream of the first guide pin 53*a* with respect to the feeding direction of the wire W that is fed in the forward direction. Also, a radially inner position of the loop Ru to be formed by the wire W is regulated by the first guide pin 53*a*.

In the meantime, the first guide pin 53*a* and the second guide pin 53*b* are set so that when the loop Ru to be formed by the wire W is considered as a circle, a distance Ds2 in a front and back direction denoted with an arrow X from the first guide pin 53*a* to a virtual center O1 is shorter than a distance Ds1 from the second guide pin 53*b* to the center O1. Also, the first guide pin 53*a* and the second guide pin 53*b* are set so that a distance Ds10 in an upper and lower direction denoted with an arrow Y from the first guide pin 53*a* to the center O1 is shorter than a distance Ds20 from the second guide pin 53*b* to the center O1. Thereby, a position of the second guide pin 53*b* is closer to the center O1 of the loop Ru in the upper and lower direction, so that the wire W is more likely to be curled.

Subsequently, the cutting unit 6A configured to cut the wire W wound around the reinforcing bars S is described. The cutting unit 6A includes a fixed blade part 60, a moveable blade part 61 configured to cut the wire W in cooperation with the fixed blade part 60, and a transmission mechanism 62 configured to transmit an operation of the binding unit 7A to the moveable blade part 61. The fixed blade part 60 has an opening 60*a* through which the wire W is to pass, and an edge portion provided at the opening 60*a* and capable of cutting the wire W.

The moveable blade part 61 is configured to cut the wire W, which is to pass through the opening 60*a* of the fixed blade part 60, by a rotating operation about a shaft 6*a*, which is a support point. The transmission mechanism 62 is configured to be displaced in conjunction with the operation of the binding unit 7A, and to rotate the moveable blade part 61 in conformity to timing at which the wire W is to be twisted after the wire W is wound on the reinforcing bars S, thereby cutting the wire W.

The fixed blade part 60 is provided downstream of the second wire guide $4A_2$ with respect to the feeding direction of the wire W that are fed in the forward direction. The opening 60*a* configures a third wire guide.

Figure 5A:
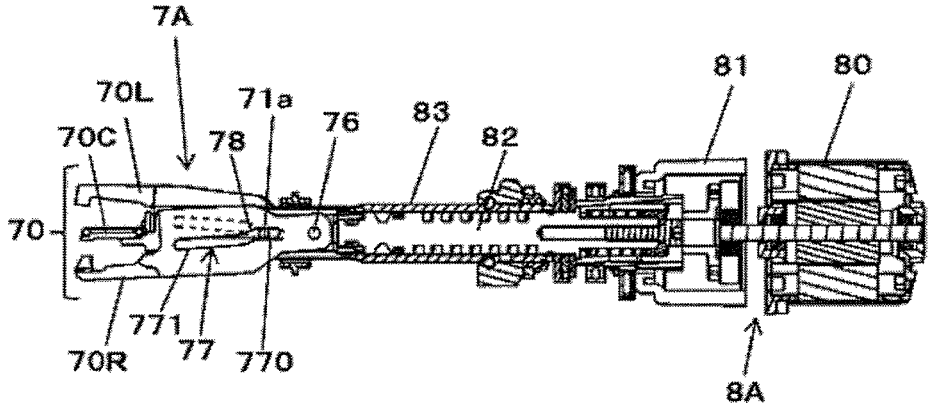
FIGS. 5A and 5B are views depicting an example of a binding unit.
Figure 5B:
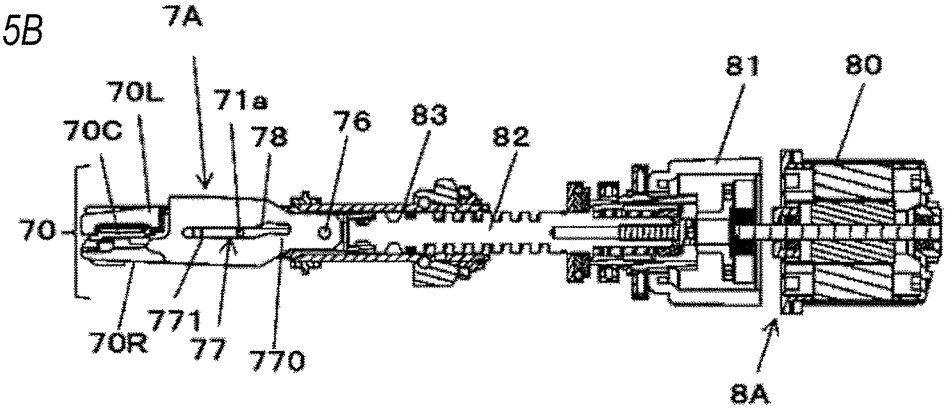
Figure 6:
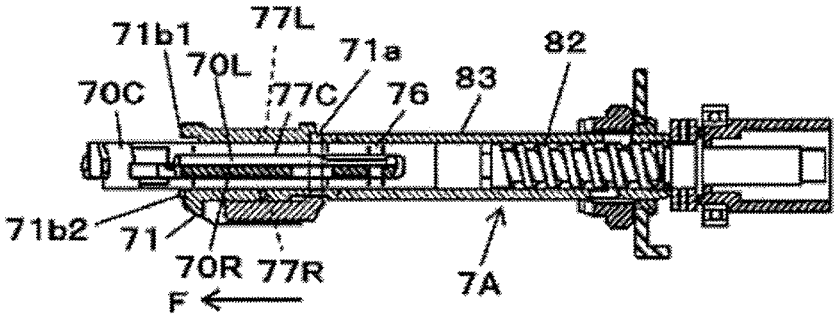
FIG. 6 is a view depicting the example of the binding unit.

FIGS. 5 and 6 depict an example of the binding unit. In the below, the binding unit 7A configured to bind the reinforcing bars S with the wire W is described.

The binding unit 7A includes a gripping part 70 configured to grip the wire W, and a bending part 71 configured to bend one end portions WS and the other end portion WE of the wire W toward the reinforcing bars S.

The gripping part 70 includes a fixed gripping member 70C, a first moveable gripping member 70L, and a second moveable gripping member 70R. The first moveable gripping member 70L and the second moveable gripping member 70R are arranged at left and right sides with the fixed gripping member 70C being interposed therebetween. Specifically, the first moveable gripping member 70L is arranged at one side along the axial direction of the wire W to be wound and the second moveable gripping member 70R is arranged at the other side, with respect to the fixed gripping member 70C.

The first moveable gripping member 70L and the fixed gripping member 70C are configured so that the wire W is to pass between tip ends of the first moveable gripping member 70L and the fixed gripping member 70C. Also, the second moveable gripping member 70R and the fixed gripping member 70C are configured so that the wire W is to pass between tip ends of the second moveable gripping member 70R and the fixed gripping member 70C.

The fixed gripping member 70C has a shaft 76 configured to rotatably support the first moveable gripping member 70L and the second moveable gripping member 70R. The fixed gripping member 70C is configured to support rear ends of the first moveable gripping member 70L and the second moveable gripping member 70R with the shaft 76. Thereby, the first moveable gripping member 70L is opened and closed in directions in which the tip end thereof separates from and comes close to the fixed gripping member 70C by a rotating operation about the shaft 76, which is a support point. Also, the second moveable gripping member 70R is opened and closed in directions in which the tip end thereof separates from and comes close to the fixed gripping member 70C by a rotating operation about the shaft 76, which is a support point.

The bending part 71 has a shape covering a periphery of the gripping part 70 and is provided to be moveable along an axial direction of the binding unit 7A. The bending part 71 has an opening and closing pin 71*a* configured to open and close the first moveable gripping member 70L and the second moveable gripping member 70R. The first moveable gripping member 70L and the second moveable gripping member 70R have an opening and closing guide hole 77 configured to open and close the first moveable gripping member 70L and the second moveable gripping member 70R by an operation of the opening and closing pin 71*a*, respectively.

The opening and closing pin 71*a* passes through an inside of the bending part 71 and is perpendicular to a moving direction of the bending part 71. The opening and closing pin 71*a* is fixed to the bending part 71, and is configured to move in conjunction with movement of the bending part 71.

The opening and closing guide hole 77 extends in a moving direction of the opening and closing pin 71*a*, and has an opening and closing portion 78 configured to convert linear movement of the opening and closing pin 71*a* into an opening and closing operation resulting from the rotation of the second moveable gripping member 70R about the shaft 76, which is a support point. The opening and closing guide hole 77 has a first standby portion 770 extending in the moving direction of the bending part 71 by a first standby distance, and a second standby portion 771 extending in the moving direction of the bending part 71 by a second standby distance. The opening and closing portion 78 extends with being bent obliquely outward from one end portion of the first standby portion 770, and couples to the second standby portion 771. Meanwhile, in FIGS. 5A and 5B, the opening and closing guide hole 77 provided to the second moveable gripping member 70R is shown. However, the first moveable gripping member 70L is also provided with the opening and closing guide hole 77 having a bilaterally symmetric shape.

As shown in FIG. 5A, as the first moveable gripping member 70L and the second moveable gripping member 70R move in the directions of getting away from the fixed gripping member 70C, the gripping part 70 is formed with a feeding path through which the wire W is to pass between the first moveable gripping member 70L and the fixed gripping member 70C and between the second moveable gripping member 70R and the fixed gripping member 70C.

The wire W that is fed by the first feeding gear 30L and the second feeding gear 30R passes between the fixed gripping member 70C and the second moveable gripping member 70R and are guided to the curl guide unit 5A. The wire W curled by the curl guide unit 5A pass between the fixed gripping member 70C and the first moveable gripping member 70L.

A side of the reinforcing bar binding machine 1A at which the curl guide unit 5A shown in FIG. 1 is provided is referred to a front side. When the bending part 71 is moved in a forward direction denoted with an arrow F in FIG. 6 and the opening and closing pin 71*a* thus pushes the opening and closing portion 78 of the opening and closing guide hole 77, the first moveable gripping member 70L and the second moveable gripping member 70R are moved in the directions of coming close to the fixed gripping member 70C by the rotating operation about the shaft 76, which is a support point.

As shown in FIG. 5B, the first moveable gripping member 70L is moved in the direction of coming close to the fixed gripping member 70C, so that the wire W is gripped between the first moveable gripping member 70L and the fixed gripping member 70C. Also, the second moveable gripping member 70R is moved in the direction of coming close to the fixed gripping member 70C, so that a gap in which the wire W can be fed is formed at a portion through which the wire W is to pass between the second moveable gripping member 70R and the fixed gripping member 70C.

The bending part 71 has a bending portion 71*b*1 configured to push one end portion WS of the wire W gripped between the first moveable gripping member 70L and the fixed gripping member 70C. Also, the bending part 71 has a bending portion 71*b*2 configured to push the other end portion WE of the wire W gripped between the second moveable gripping member 70R and the fixed gripping member 70C.

The bending part 71 is moved in the forward direction denoted with the arrow F, so that one end portion WS of the wire W gripped by the fixed gripping member 70C and the first moveable gripping member 70L are pushed by the bending portion 71*b*1 and are thus bent toward the reinforcing bars S. Also, the bending part 71 is moved in the forward direction denoted with the arrow F, so that the other end portion WE of the wire W having passed between the fixed gripping member 70C and the second moveable gripping member 70R are pushed by the bending portion 71*b*1 and are thus bent toward the reinforcing bars S.

As shown in FIG. 2, the binding unit 7A includes a length regulation part 74 configured to regulate positions of one end portion WS of the wire W. The length regulation part 74 is configured by providing a member, to which one end portion WS of the wire W is to be butted, on the feeding path of the wire W having passed between the fixed gripping member 70C and the first moveable gripping member 70L.

Figure 7A:
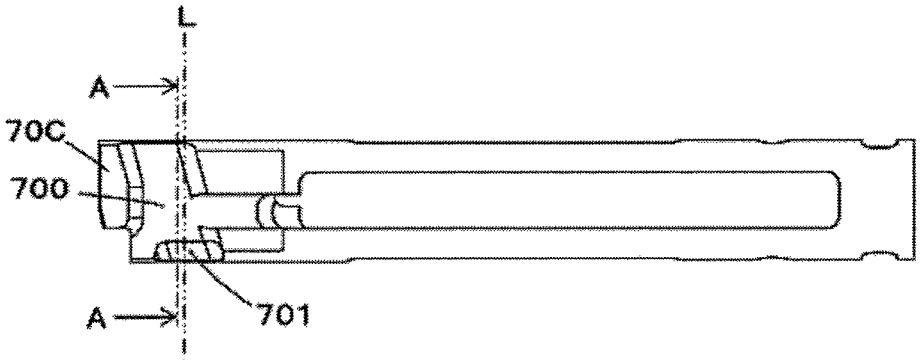
FIGS. 7A and 7B are views depicting an example of a fixed gripping member.
Figure 7B:
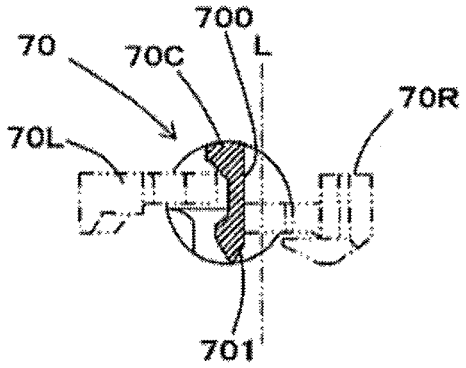

FIGS. 7A and 7B depict an example of the fixed gripping member, in which FIG. 7A is a side view of the fixed gripping member and FIG. 7B is a sectional taken along a line A-A of FIG. 7A. The fixed gripping member 70C has an introduction guide part 701 at a wire introduction-side of a surface 700 facing the second moveable gripping member 70R.

The introduction guide part 701 is configured by providing a linear or curved inclined surface, which is inclined in a direction of retracting from the feeding path L of the wire W toward the introduction-side of the wire W, to a corner portion of the introduction-side of the wire W to be fed in the forward direction at a position facing the feeding path L of the wire W to pass between the fixed gripping member 70C and the second moveable gripping member 70R.

Also, the binding unit 7A includes a rotary shaft 82, a moveable member 83, which is an operated member configured to be displaced by a rotating operation of the rotary shaft 82, and a rotation regulation member 84 configured to regulate rotation of the moveable member 83 coupled to the rotating operation of the rotary shaft 82. Also, the reinforcing bar binding machine 1A includes a drive unit 8A configured to drive the binding unit 7A. The drive unit 8A includes a motor 80, and a decelerator 81 for deceleration and torque amplification. The rotary shaft 82 is driven by the motor 80 via the decelerator 81.

The rotary shaft 82 and the moveable member 83 are configured so that the rotating operation of the rotary shaft 82 is converted into movement in a front and back direction along the rotary shaft 82 of the moveable member 83 by a screw part provided to the rotary shaft 82 and a nut part provided to the moveable member 83. The binding unit 7A has the bending part 71 integrated with the moveable member 83, so that the movement of the moveable member 83 in the front and back direction causes the bending part 71 to move in the front and back direction.

In an operation area in which the wire W is gripped by the gripping part 70 and the wire W is bent by the bending part 71, the moveable member 83, the bending part 71, and the gripping part 70 supported to the bending part 71 are engaged with the rotation regulation member 84, and are thus moved in the front and back direction with the rotating operation being regulated by the rotation regulation member 84. Also, when the moveable member 83, the bending part 71 and the gripping part 70 are disengaged from the rotation regulation member 84, they are rotated by the rotating operation of the rotary shaft 82.

The gripping part 70 is configured so that the fixed gripping member 70C, the first moveable gripping member 70L and the second moveable gripping member 70R gripping the wire W are rotated in conjunction with the rotation of the moveable member 83 and the bending part 71.

The retraction mechanism 53 of the first guide pin 53*a* is configured by a link mechanism configured to convert the movement of the moveable member 83 in the front and back direction into the displacement of the first guide pin 53*a*. Also, the transmission mechanism 62 of the moveable blade part 61 is configured by a link mechanism configured to convert the movement of the moveable member 83 in the front and back direction into the rotating operation of the moveable blade part 61.

Subsequently, a shape of the reinforcing bar binding machine 1A is described. The reinforcing bar binding machine 1A is used with being gripped by an operator's hand. The reinforcing bar binding machine 1A has a main body part 10A and a handle part 11A.

The first guide 50 and the second guide 51 of the curl guide unit 5A of the reinforcing bar binding machine 1A are provided at a front end portion of the main body part 10A. Also, the wire feeding unit 3A, the cutting unit 6A, the drive unit 8A, the binding unit 7A configured to drive by the drive unit 8A, and the like of the reinforcing bar binding machine 1A are accommodated in the main body part 10A. Also, the handle part 11A of the reinforcing bar binding machine 1A extends in one direction from the main body part 10A.

Also, the magazine 2A of the reinforcing bar binding machine 1A is provided in front of the handle part 11A.

The reinforcing bar binding machine 1A has a housing 100 configuring an exterior package thereof. The housing 100 is a molded product of resin or the like. The housing 100 configures an exterior package of the main body part 10A and the handle part 11A. The main body part 10A and the handle part 11A are provided integrally with each other.

Subsequently, an operation unit of the reinforcing bar binding machine 1A is described. The handle part 11A of the reinforcing bar binding machine 1A is provided at a front side with a trigger 12A. In correspondence to a state of a switch 13A that is pressed when the trigger 12A is operated, a control unit 14A controls the feeding motor 33 and the motor 80. Also, a battery 15A is detachably mounted to a lower part of the handle part 11A.

Figure 8:
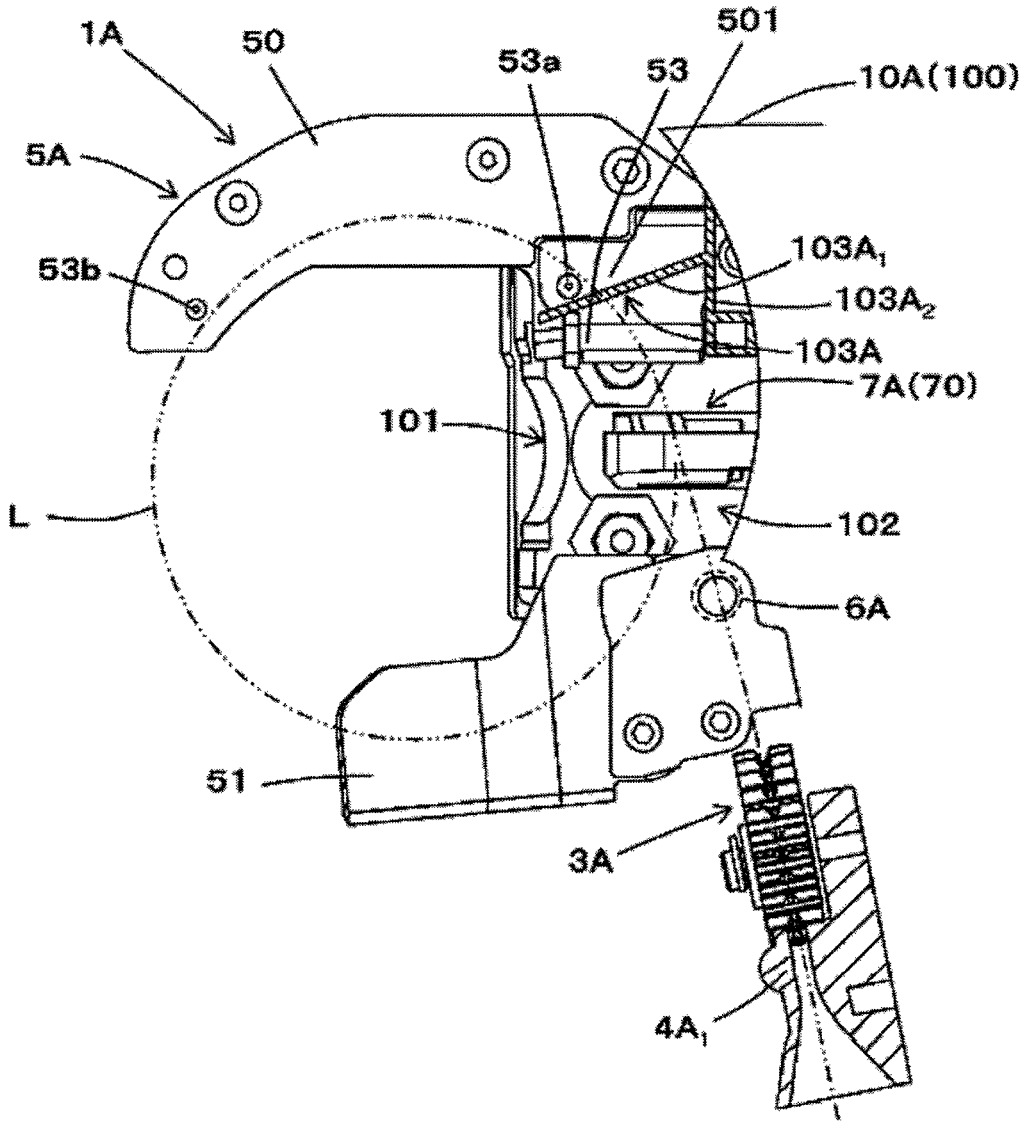
FIG. 8 is a side view depicting the example of the main configuration of the reinforcing bar binding machine of the embodiment.
Figure 9:
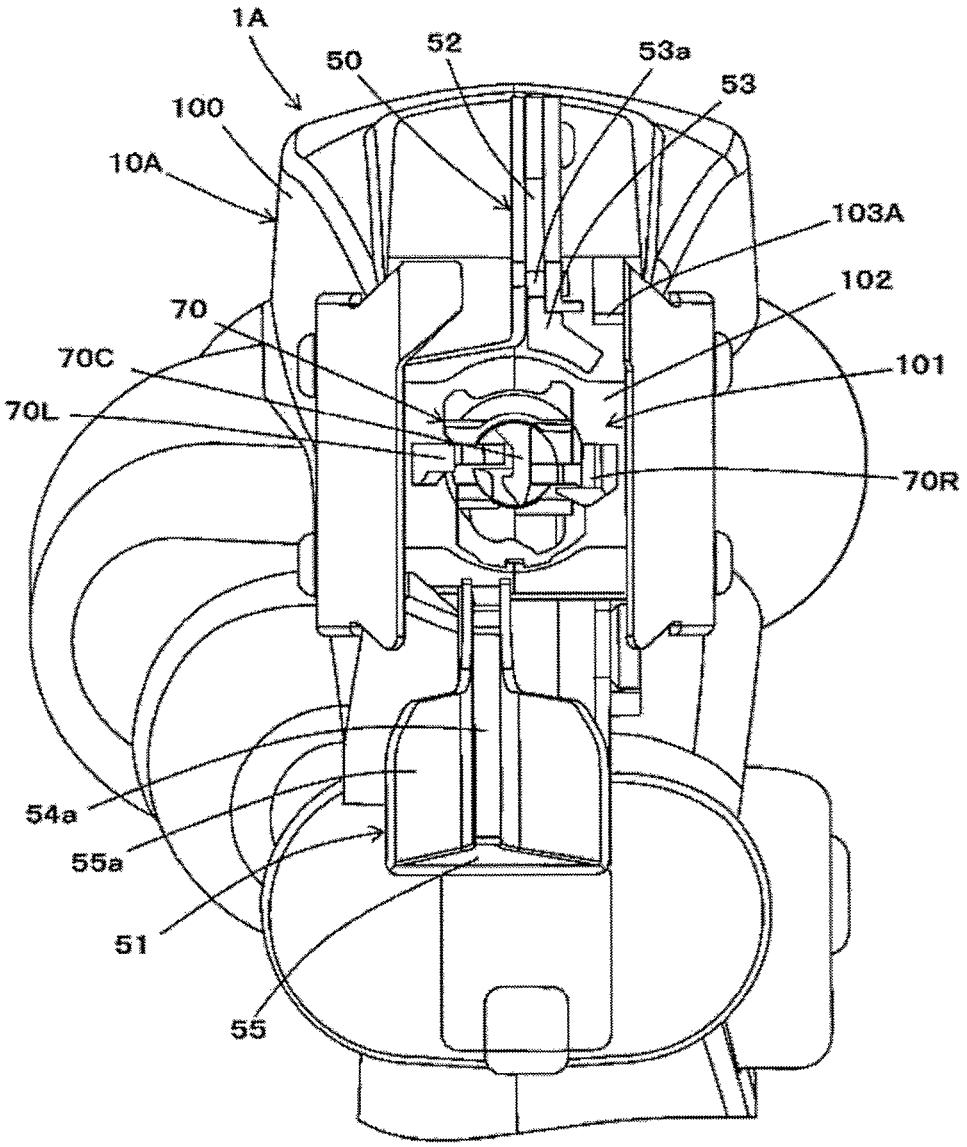
FIG. 9 is a front view depicting the example of the main configuration of the reinforcing bar binding machine of the embodiment.
Figure 10:
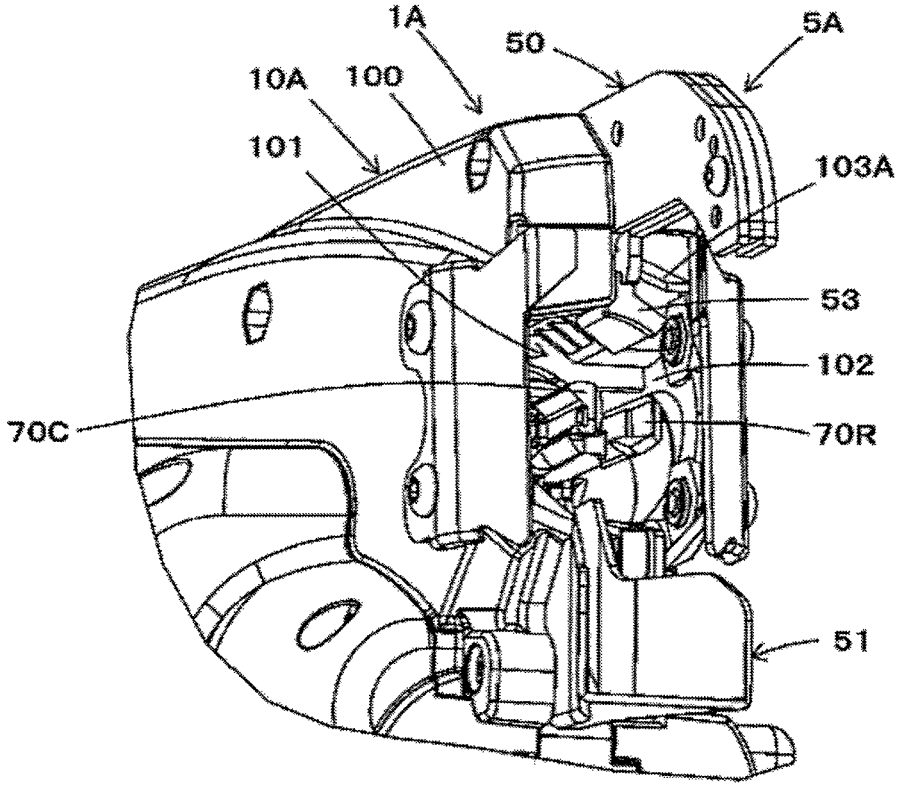
FIG. 10 is a perspective view depicting the example of the main configuration of the reinforcing bar binding machine of the embodiment, as seen from front.

FIG. 8 is a side view depicting an example of the main configuration of the reinforcing bar binding machine of the embodiment, FIG. 9 is a front view depicting an example of the main configuration of the reinforcing bar binding machine of the embodiment, and FIG. 10 is a perspective view depicting an example of the main configuration of the reinforcing bar binding machine of the embodiment, as seen from front. In the below, a configuration of preventing the wire W from entering outside the feeding path is described.

The reinforcing bar binding machine 1A has an opening portion 101 through which the wire S passes during the operation of binding the reinforcing bars S with the wire W. The opening portion 101 is configured by an opening provided at a front end of the main body part 10A and between the first guide 50 and the second guide 51 of the curl guide unit 5A.

Also, the main body part 10A has an operation space 102 in which the gripping part 70 and the bending part 71 of the binding unit 7A operate. The operation space 102 is provided at the rear of the opening portion 101.

The reinforcing bar binding machine 1A includes an entry regulation convex part 103A configured to prevent the wire W from deviating from the predetermined feeding path L in the operation space 102 and entering into an entry regulation area.

The entry regulation convex part 103A is an example of the entry regulation part. The entry regulation part 103A is configured by a convex part provided (located) on an inner surface of the housing 100 at a side at which the second moveable gripping member 70R in a standby state is positioned, in the main body part 10A.

The entry regulation convex part 103A is provided (located) at one side of the introduction part 501 of the first guide 50 at a downstream side of the binding unit 7A with respect to the feeding direction of the wire W to be fed toward the first guide 50 by the wire feeding unit 3A.

The entry regulation convex part 103A protrudes toward the introduction part 501 of the first guide 50 from a part, which is positioned at one side of the introduction part 501 of the first guide 50, of the inner surface of the housing 100. Specifically, the retraction mechanism 53 of the first guide pin 53*a* is provided (located) at one side of the introduction part 501 of the first guide 50, and the entry regulation convex part 103A protrudes toward the retraction mechanism 53 of the first guide pin 53*a* from a part, which is positioned at a side of the retraction mechanism 53 of the first guide pin 53*a*, of the inner surface of the housing 100 so as to prevent the wire W from entering into a side of the retraction mechanism 53. In this example, the entry regulation area is a moveable area of the retraction mechanism 53 of the first guide pin 53*a*.

The retraction mechanism 53 moves along an axial direction of the first guide pin 53*a*, so that it is retracted in a direction of coming close to the entry regulation convex part 103A. For this reason, a protrusion height of the entry regulation convex part 103A is set to a height that does not interfere with the movement of the retraction mechanism 53 to the retraction position. In this example, the protrusion height of the entry regulation convex part 103A is set to a height at which the retraction mechanism 53 having moved to the retraction position is not contacted.

The entry regulation convex part 103A has a discharge guide part 103$A_1$ that guides the wire W toward the opening portion 101 in a discharge direction to an outside of the main body part 10A when the wire W incapable of being normally fed is contacted thereto, and an entry regulation part (rear-entry regulation part) 103$A_2$ configured to prevent the wire W incapable of being normally fed from entering into the rear of the operation space 102.

In this example, a surface of the discharge guide part 103$A_1$, to which the wire W is contacted, is configured by a linear inclined surface of which a side closer to the opening portion 101 is inclined in a direction of coming close to the wire feeding unit 3A with respect to the discharge direction to an outside of the main body part 10A of the wires from the operation space 102 toward the opening portion 101, i.e., is inclined in a downstream direction with respect to the feeding direction of the wire W to be fed from the wire feeding unit 3A toward the first guide 50.

The rear-entry regulation part 103$A_2$ is configured by a convex part continuing from the discharge guide part 103$A_1$ at the rear of the operation space 102 opposite to the opening portion 101.

<Example of Operation of Reinforcing Bar Binding Machine of Embodiment>

FIGS. 11A to 11D illustrate an example of an operation of gripping and twisting the wires in detail. In the below, an operation of binding the reinforcing bars S with the two wires W by the reinforcing bar binding machine 1A of the embodiment is described with reference to each drawing.

The reinforcing bar binding machine 1A is in a standby state where the wire W is sandwiched between the first feeding gear 30L and the second feeding gear 30R, and the tip end of the wire W is positioned from the sandwiching position between the first feeding gear 30L and the second feeding gear 30R to the fixed blade part 60 of the cutting unit 6A. Also, as shown in FIG. 5A, when the reinforcing bar binding machine 1A is in the standby state, the first moveable gripping member 70L opens with respect to the fixed gripping member 70C and the second moveable gripping member 70R opens with respect to the fixed gripping member 70C.

When the reinforcing bars S are inserted between the first guide 50 and the second guide 51 of the curl guide unit 5A and the trigger 12A is operated, the feeding motor 33 is driven in the forward rotation direction, so that the first feeding gear 30L is rotated in the forward direction and the second feeding gear 30R is also rotated in the forward direction in conjunction with the first feeding gear 30L. Thereby, the two wires W sandwiched between the first feeding gear 30L and the second feeding gear 30R are fed in the forward direction.

The first wire guide $4A_1$ is provided upstream of the wire feeding unit 3A and the second wire guide $4A_2$ is provided downstream of the wire feeding unit 3A with respect to the feeding direction of the wire W to be fed in the forward direction, so that the two wires W are fed with being aligned in parallel.

When the wire W is fed in the forward direction, the wire W passes between the fixed gripping member 70C and the second moveable gripping member 70R and pass through the guide groove 52 of the first guide 50 of the curl guide unit 5A. Thereby, the wire W is guided (supported) by the second wire guide $4A_2$, and the wire W is curled to be wound around the reinforcing bars S at two points of the first guide pin 53*a* and the second guide pin 53*b* of the first guide 50.

Figure 11A:
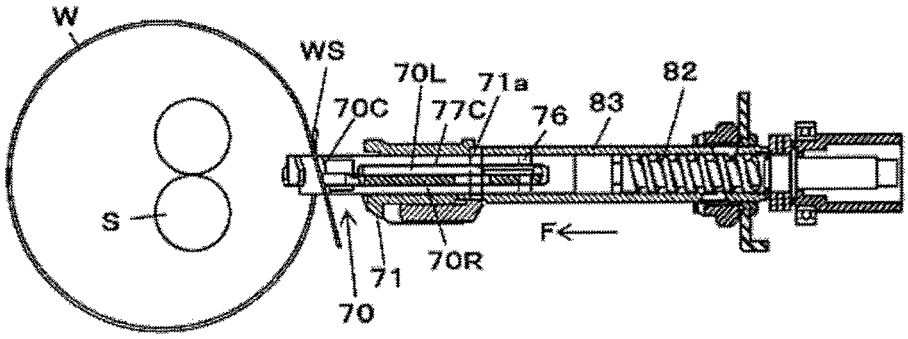
FIGS. 11A to 11D illustrates an example of an operation of gripping and twisting wires in detail.

The wire W delivered from the first guide 50 is guided between the fixed gripping member 70C and the first moveable gripping member 70L by the second guide 51. Then, when the tip end of the wire W is fed to positions at which the tip ends are butted to the length regulation part 74, the driving of the feeding motor 33 is stopped. Thereby, as shown in FIG. 11A, the wire W is wound in a loop shape around the reinforcing bars S.

After stopping the feeding of the wire W, the motor 80 is driven in the forward rotation direction, so that the motor 80 moves the moveable member 83 in the arrow F direction, which is a forward direction. That is, a rotating operation of the moveable member 83 coupled to the rotation of the motor 80 is regulated by the rotation regulation member 84, so that the rotation of the motor 80 is converted into the linear movement. Thereby, the moveable member 83 is moved forward.

In conjunction with the forward movement of the moveable member 83, the bending part 71 is moved forward integrally with the moveable member 83, without being rotated. When the bending part 71 is moved forward, the opening and closing pin 71*a* passes through the opening and closing portion 78 of the opening and closing guide hole 77, as shown in FIG. 5B.

Thereby, the first moveable gripping member 70L is moved in the direction of coming close to the fixed gripping member 70C through the rotating operation about the shaft 76, which is a support point. Therefore, one end portion WS of the wire W is gripped between the first moveable gripping member 70L and the fixed gripping member 70C. Also, the second moveable gripping member 70R is moved in the direction of coming close to the fixed gripping member 70C through the rotating operation about the shaft 76, which is a support point. Therefore, a gap in which the wire W can be fed is formed at a portion through which the wire W is to pass between the second moveable gripping member 70R and the fixed gripping member 70C.

Also, when the moveable member 83 is moved forward, the operation of the moveable member 83 is transmitted to the retraction mechanism 53, so that the first guide pin 53*a* is retracted.

After advancing the moveable member 83 to a position at which the wire W is gripped through the opening and closing operation of the first moveable gripping member 70L and the second moveable gripping member 70R, the rotation of the motor 80 is temporarily stopped and the feeding motor 33 is driven in the reverse rotation direction. Thereby, the first feeding gear 30L is reversed, and the second feeding gear 30R is also reversed in conjunction with the first feeding gear 30L.

Figure 11B:
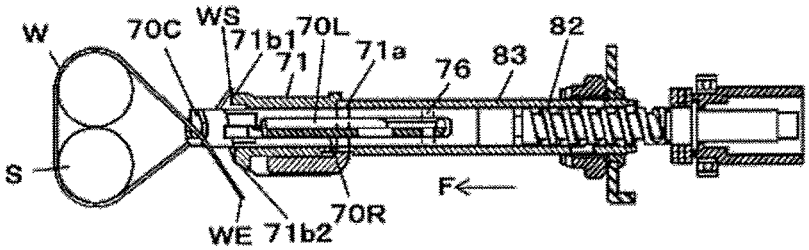

Therefore, the wires S sandwiched between the first feeding gear 30L and the second feeding gear 30R are fed in the reverse direction. During the operation of feeding the wire W in the reverse direction, the wire W is wound on the reinforcing bars S with being closely contacted thereto, as shown in FIG. 11B.

After winding the wire W on the reinforcing bars S and stopping the driving of the feeding motor 33 in the reverse rotation direction, the motor 80 is driven in the forward rotation direction, so that the moveable member 83 is moved forward. The forward moving operation of the moveable member 83 is transmitted to the cutting unit 6A by the transmission mechanism 62, so that the moveable blade part 61 is rotated and the other end portion WE of the wire W gripped with the second moveable gripping member 70R and the fixed gripping member 70C are cut by the operation of the fixed blade part 60 and the moveable blade part 61.

When binding the reinforcing bars S with the two wires W, like this example, it is possible to secure the strength equivalent to the case where the reinforcing bars S are bound with one wire even when making a diameter of the respective wire W thinner. For this reason, it is possible to easily bend the wire W and to bring the wire W into close contact with the reinforcing bars S with the lower force. Therefore, it is possible to wind the wire W on the reinforcing bars S with the lower force. Also, it is possible to reduce the load when cutting the wire W. Accompanied by this, it is possible to miniaturize each motor and the mechanism part of the reinforcing bar binding machine 1A, thereby miniaturizing the entire main body part. Also, the motor is miniaturized and the load is reduced, so that it is possible to reduce the power consumption.

Figure 11C:
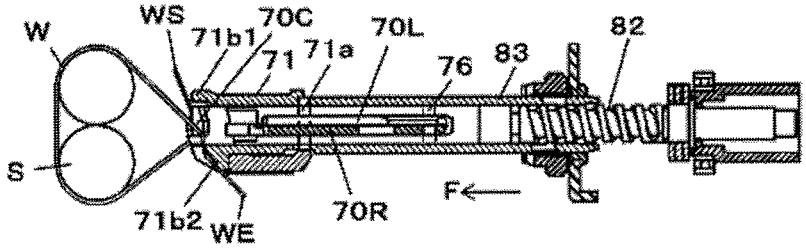

After cutting the wire W, the moveable member 83 is further moved forward, so that the bending part 71 is moved forward integrally with the moveable member 83, as shown in FIG. 11C. The bending part 71 is moved in the direction of coming close to the reinforcing bars S, which is the forward direction denoted with the arrow F, so that one end portion WS of the wire W gripped with the fixed gripping member 70C and the first moveable gripping member 70L are pressed toward the reinforcing bars S by the bending portion 71*b*1, and are thus bent toward the reinforcing bars S at the gripping position, which is a support point. The bending part 71 is further moved forward, so that one end portion WS of the wire W is held with being gripped between the first moveable gripping member 70L and the fixed gripping member 70C.

Also, the bending part 71 is moved in the direction of coming close to the reinforcing bars S, which is the forward direction denoted with the arrow F, so that the other end portion WE of the wire W gripped with the fixed gripping member 70C and the second moveable gripping member 70R are pressed toward the reinforcing bars S by the bending portion 71*b*2, and are thus bent toward the reinforcing bars S at the gripping position, which is a support point. The bending part 71 is further moved forward, so that the wire W is supported between the second moveable gripping member 70R and the fixed gripping member 70C.

After bending the end portion of the wire W toward the reinforcing bars S, the motor 80 is further driven in the forward rotation direction, so that the motor 80 further moves the moveable member 83 in the forward direction denoted with the arrow F. The moveable member 83 is moved to a predetermined position in the arrow F direction, so that the moveable member 83 is disengaged from the rotation regulation member 84 and the rotation regulation state of the moveable member 83 by the rotation regulation member 84 is released.

Figure 11D:
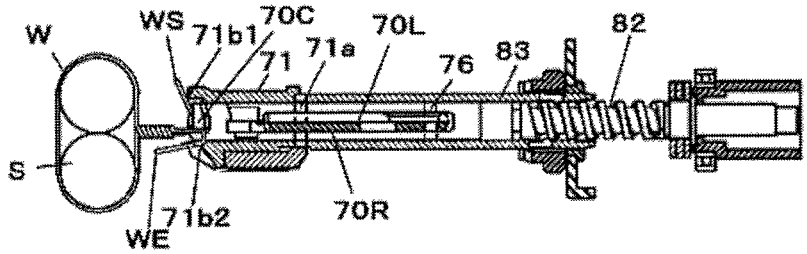

Thereby, the motor 80 is further driven in the forward rotation direction, so that the gripping part 70 gripping the wire W is rotated integrally with the bending part 71 and twists the wire W, as shown in FIG. 11D.

After twisting the wire W, the motor 80 is driven in the reverse rotation direction, so that the motor 80 moves the moveable member 83 in a backward direction denoted with an arrow R. That is, the rotating operation of the moveable member 83 coupled to the rotation of the motor 80 is regulated by the rotation regulation member 84, so that the rotation of the motor 80 is converted into the linear movement.

Thereby, the moveable member 83 is moved backward. As the moveable member 83 is moved backward, the first moveable gripping member 70L and the second moveable gripping member 70R are displaced in the directions of separating from the fixed gripping member 70C, so that the gripping part 70 releases the wire W.

Figure 12:
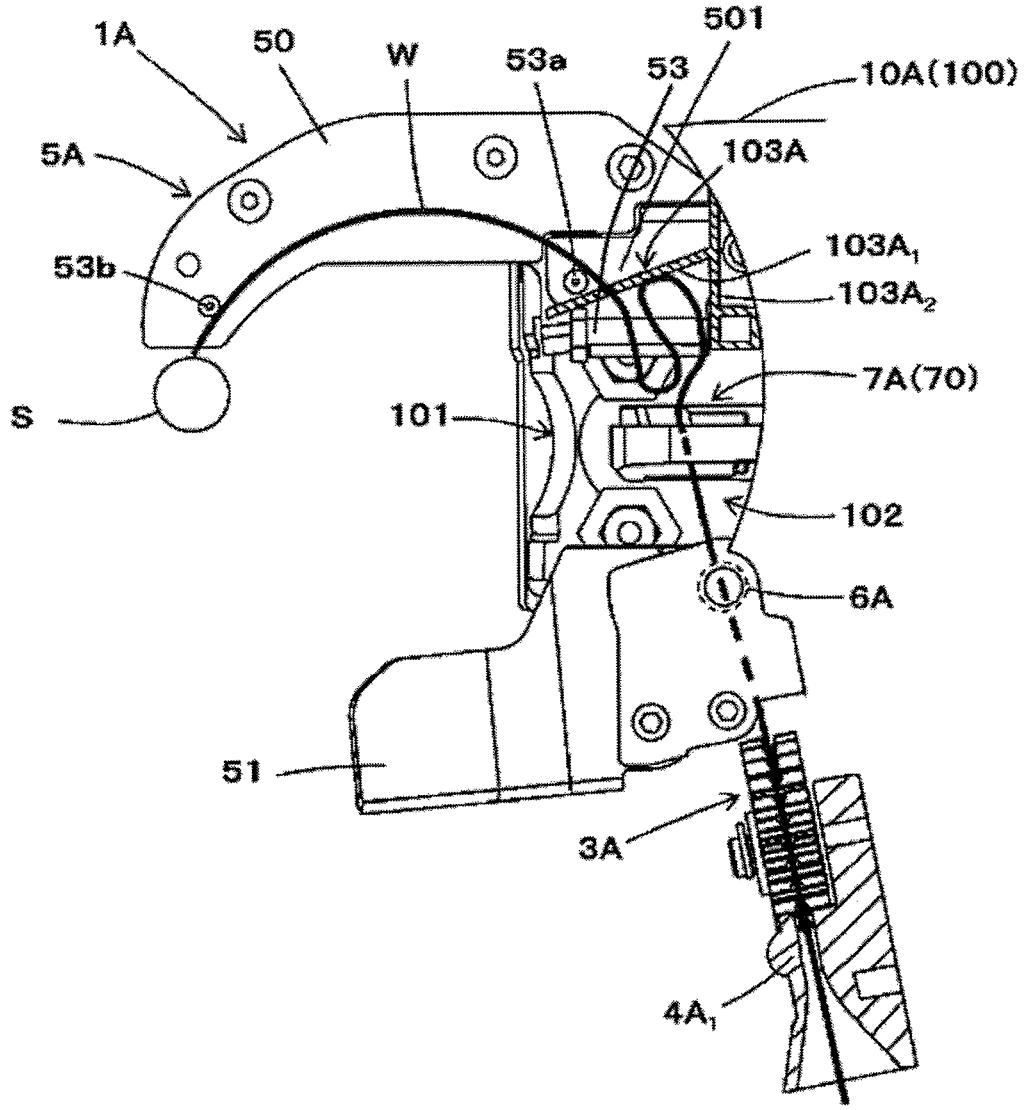
FIG. 12 is a side view depicting an example of an operation that is performed when the wire cannot be normally fed.
Figure 13:
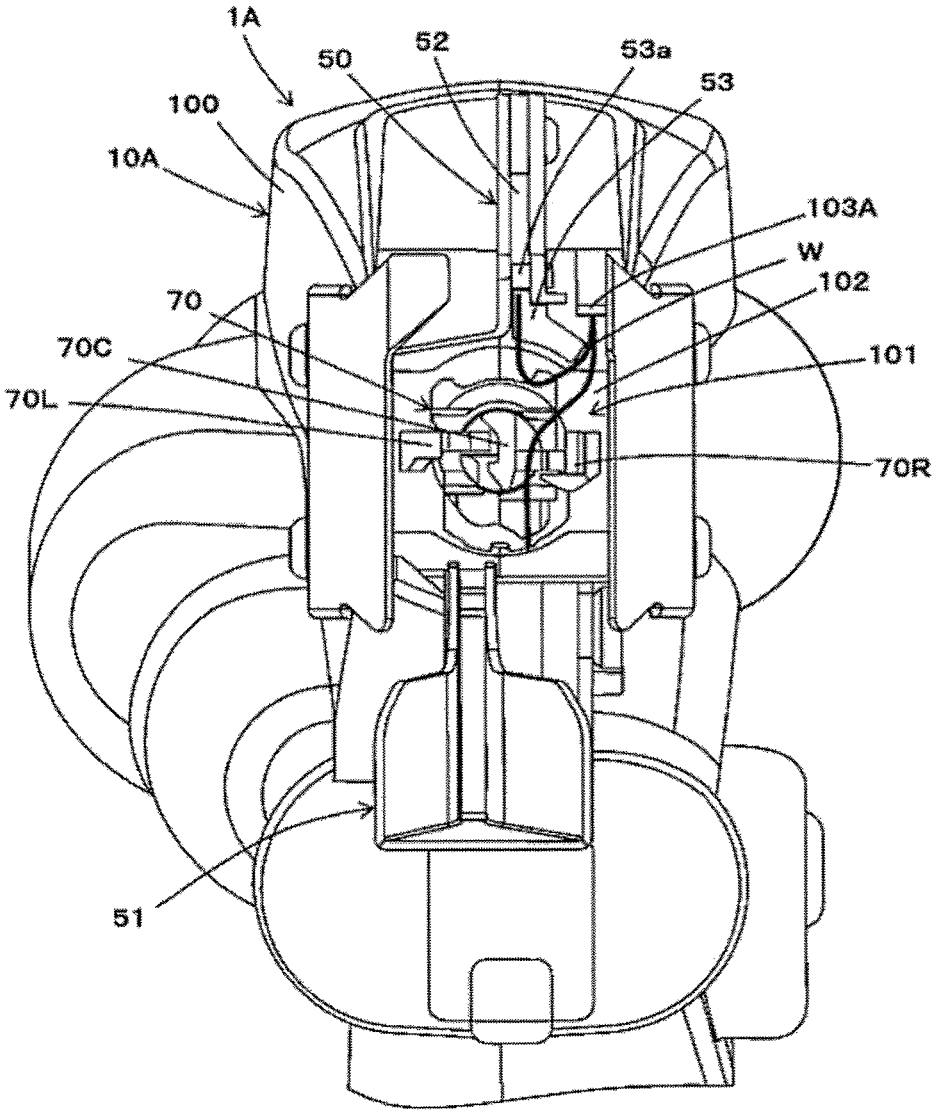
FIG. 13 is a front view depicting the example of the operation that is performed when the wire cannot be normally fed.
Figure 14:
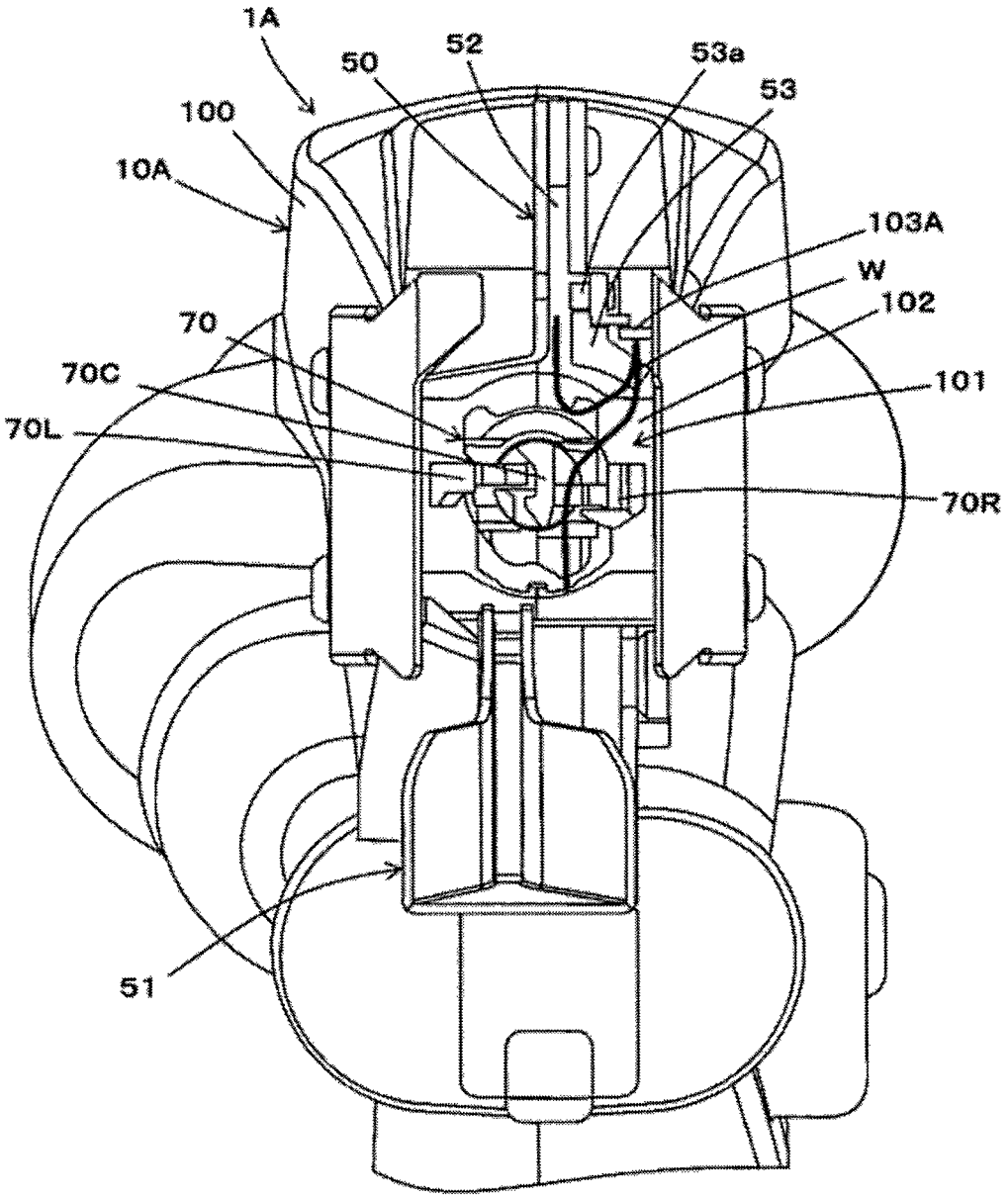
FIG. 14 is a front view depicting the example of the operation that is performed when the wire cannot be normally fed.

FIG. 12 is a side view depicting an example of an operation that is performed when the wire cannot be normally fed, and FIGS. 13 and 14 are front views depicting an example of an operation that is performed when the wire cannot be normally fed. In the below, an operation that is performed when the wire W cannot be normally fed is described.

In the reinforcing bar binding machine 1A, a rotating amount of the feeding motor 33 in the forward direction is set, in correspondence to a feeding amount of the wire W required to form the loop Ru by the wire W by winding the wire W around the reinforcing bars S with the curl guide unit 5A.

When the reinforcing bars S inserted between the first guide 50 and the second guide 51 are not located at predetermined positions and the tip end of the wire W being fed by the wire feeding unit 3A are contacted to the reinforcing bars S, it is not possible to feed the wire W beyond the reinforcing bars S.

However, since the feeding motor 33 is continuously rotated by a predetermined amount, the wire W is continuously fed in the forward direction. When the wire W is continuously fed at a state where the wire W cannot be normally fed, the wire W tends to move in a direction of deviating from the normal feeding path L.

Since the feeding path of the wire W introduced into the first guide 50 is regulated by the first guide pin 53*a* and the guide groove 52, the wires are suppressed from deviating from the normal feeding path L. Also, since the feeding path of the wires is regulated by the fixed blade part 60 of the cutting unit 6A at the upstream side of the fixed gripping member 70C and the second moveable gripping member 70R, the wire W is suppressed from deviating from the normal feeding path L.

In the meantime, the operation space 102 has a space into which the wire W can enter, except for the normal feeding path L. For this reason, at a state where the wire W is fed up to a position at which the tip end thereof protrudes from the discharge-side of the first guide 50, when the wire W is continuously fed by a predetermined amount after the wire W cannot be normally fed, the wire W from a part between the second moveable gripping member 70R and the fixed gripping member 70C to a part at which the wire is introduced to the first guide 50 deviates from the feeding path L and is bent (buckled) due to the continuous feeding operation of the wire W, as shown in FIGS. 12 and 13.

As shown in FIG. 13, the wire W buckled due to the feeding of the wire W faces toward the housing 100 at a side at which the second moveable gripping member 70R in the standby state is located. The entry regulation convex part 103A is provided at a position toward which the buckled wire W faces. Thereby, the buckled wire W collides with the entry regulation convex part 103A, so that even though the wire W is further fed, the wire is prevented from entering into the retraction mechanism 53 beyond the entry regulation convex part 103A. Also, the buckled wire W is prevented from entering into the rear of the operation space 102 beyond the rear-entry regulation part 103$A_2$.

As described above, as a series of operations of binging the reinforcing bars S with the wire W, the operation of feeding the wire W in the forward direction by a predetermined amount with the wire feeding unit 3A, the operation of stopping the feeding of the wire W and then advancing the bending part 71 with the binding unit 7A, the operation of binding the first moveable gripping member 70L and the second moveable gripping member 70R with the advancement of the bending part 71, the operation of retracting the first guide pin 53*a* with the advancement of the bending part 71, the operation of feeding the wire W in the reverse direction by a predetermined amount with the wire feeding unit 3A, and the operation of cutting the wire W with the cutting unit 6A are performed.

When the wire W is buckled in the operation space 102, the wire W is prevented from entering into the retraction mechanism 53 beyond the entry regulation convex part 103A. Therefore, as shown in FIG. 14, it is possible to suppress the wire W from being caught at the retraction mechanism 53 during the operation of retracting the first guide pin 53*a*.

Also, a part, which is contacted to the discharge guide part 103$A_1$ of the entry regulation convex part 103A, of the wire W buckled in the operation space 102 is guided toward the opening portion 101 by the feeding of the wire W in the forward direction. Thereby, when the buckled wire W is cut with the cutting unit 6A, the cut wire W is easily discharged from the opening portion 101 by inclining the reinforcing bar binding machine 1A so that the opening portion 101 faces downward.

Figure 15:
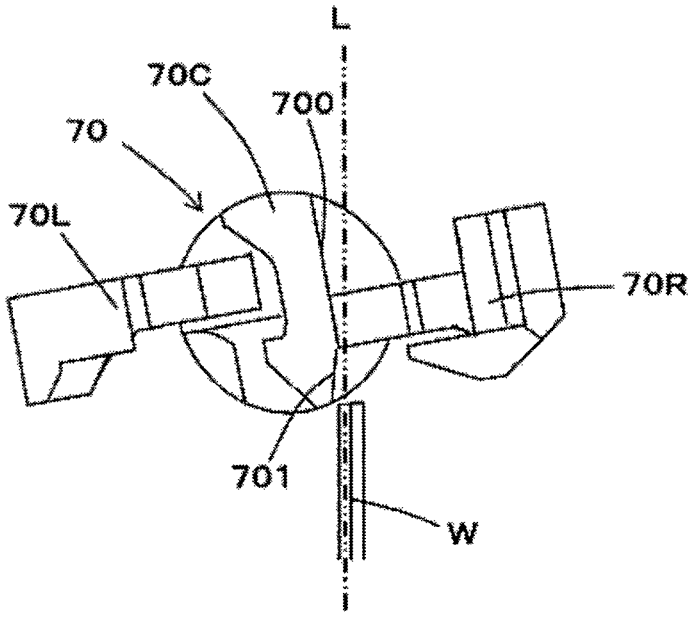
FIG. 15 is a front view of main parts depicting an example of an operation of mounting the wire.

FIG. 15 is a front view of main parts depicting an example of an operation of mounting the wire. In the below, a function of suppressing occurrence of an abnormality during the operation of mounting the wire W is described. The fixed gripping member 70C, the first moveable gripping member 70L and the second moveable gripping member 70R are attached to the bending part 71, as described above, so that the gripping part 70 is rotated together with the bending part 71 by the operation of the rotary shaft 82.

In the standby state, a surface 700, which faces the second moveable gripping member 70R, of the fixed gripping member 70C of the gripping part 70 is substantially parallel with the feeding path L of the wire W. In the standby state, the wire W passing through the first wire guide 4$A_1$, the first feeding gear 30L, the second feeding gear 30R and the second wire guide 4$A_2$ passes between the fixed gripping member 70C and the second moveable gripping member 70R.

However, in the standby state, the gripping part 70 may be inclined in the rotation direction due to tolerances of the respective components. In a configuration of the related art where the fixed gripping member 70C is not provided with the introduction guide part 701, when the wire introduction-side of the fixed gripping member 70C is inclined in a direction of coming close to the feeding path L of the wire W, if the wire W is contacted to the fixed gripping member 70C, the wire W cannot be fed beyond the fixed gripping member 70C, so that the wires may not be fed between the fixed gripping member 70C and the second moveable gripping member 70R.

In contrast, the fixed gripping member 70C is provided with the introduction guide part 701 at the wire introduction-side. Therefore, even when the wire introduction-side of the fixed gripping member 70C is inclined in a direction of coming close to the feeding path L of the wire W, the wire W is contacted to the introduction guide part 701, so that the wire W is guided between the fixed gripping member 70C and the second moveable gripping member 70R. Thereby, it is possible to suppress the feeding defect, which is caused as the wire W is contacted the fixed gripping member 70C.

In particular, in the configuration of the related art, when the two wires W are fed with being aligned in parallel, the feeding defect, where one wire W is not fed due to the contact with the fixed gripping member 70C and the other wire W is not contacted to the fixed gripping member 70C and is thus fed, may occur. In contrast, the fixed gripping member 70C is provided with the introduction guide part 701, so that even one wire W in contact with the fixed gripping member 70C is guided between the fixed gripping member 70C and the second moveable gripping member 70R by the introduction guide part 701. Thereby, it is possible to feed the two wires W while keeping the state where the wires are aligned in parallel.

<Modified Embodiments of Reinforcing Bar Binding Machine of Embodiment>

Figure 16:
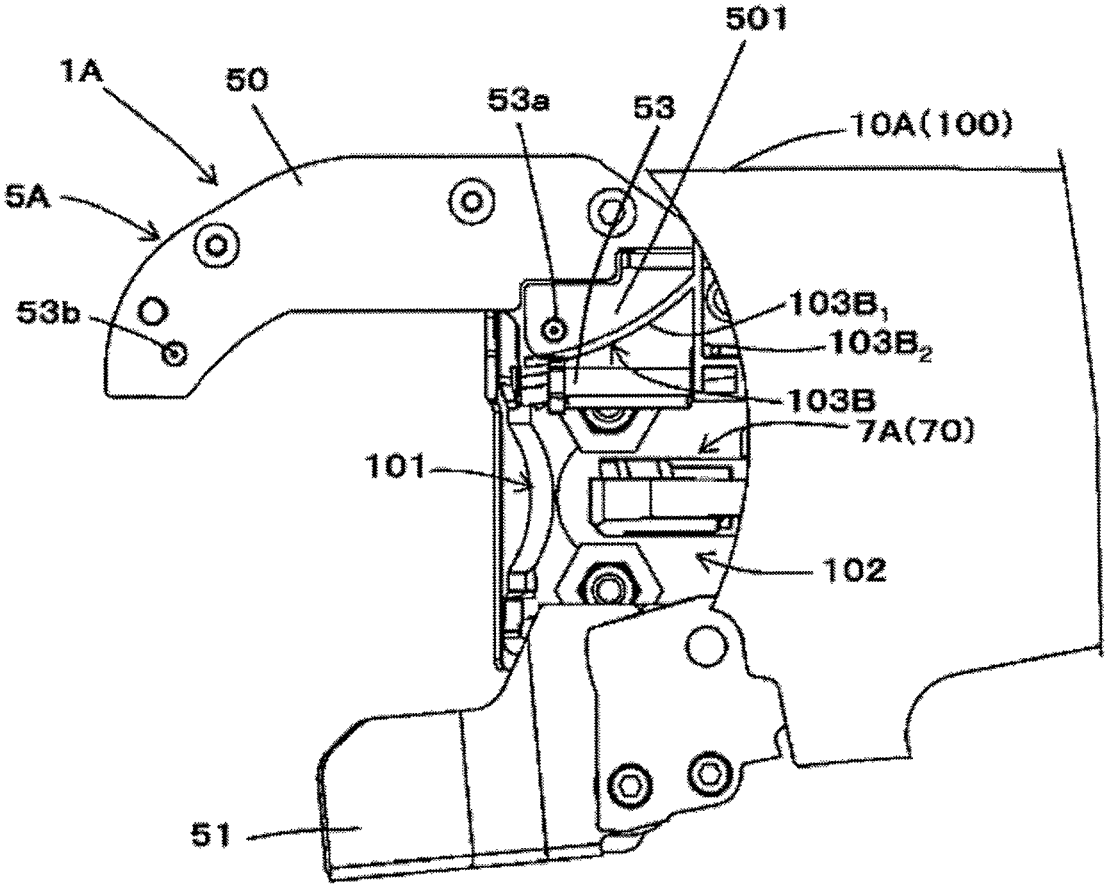
FIG. 16 is a side view depicting an example of a main configuration of a reinforcing bar binding machine in accordance with a modified embodiment of the embodiment.
Figure 17:
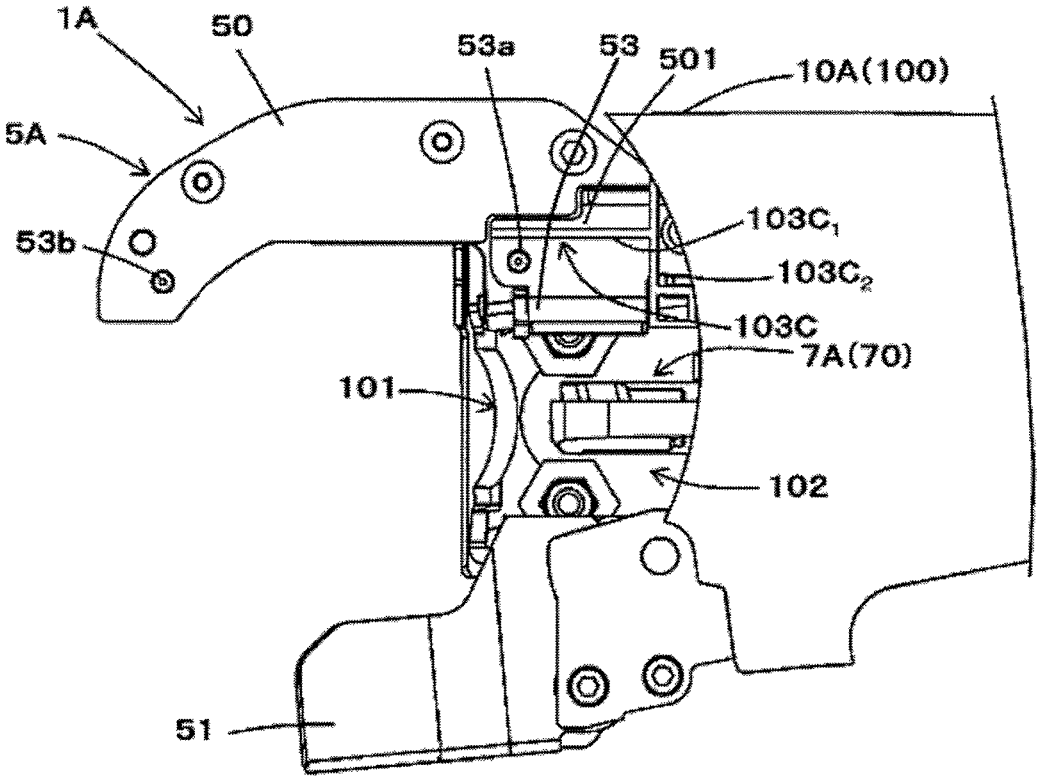
FIG. 17 is a side view depicting an example of a main configuration of a reinforcing bar binding machine in accordance with a modified embodiment of the embodiment.
Figure 18:
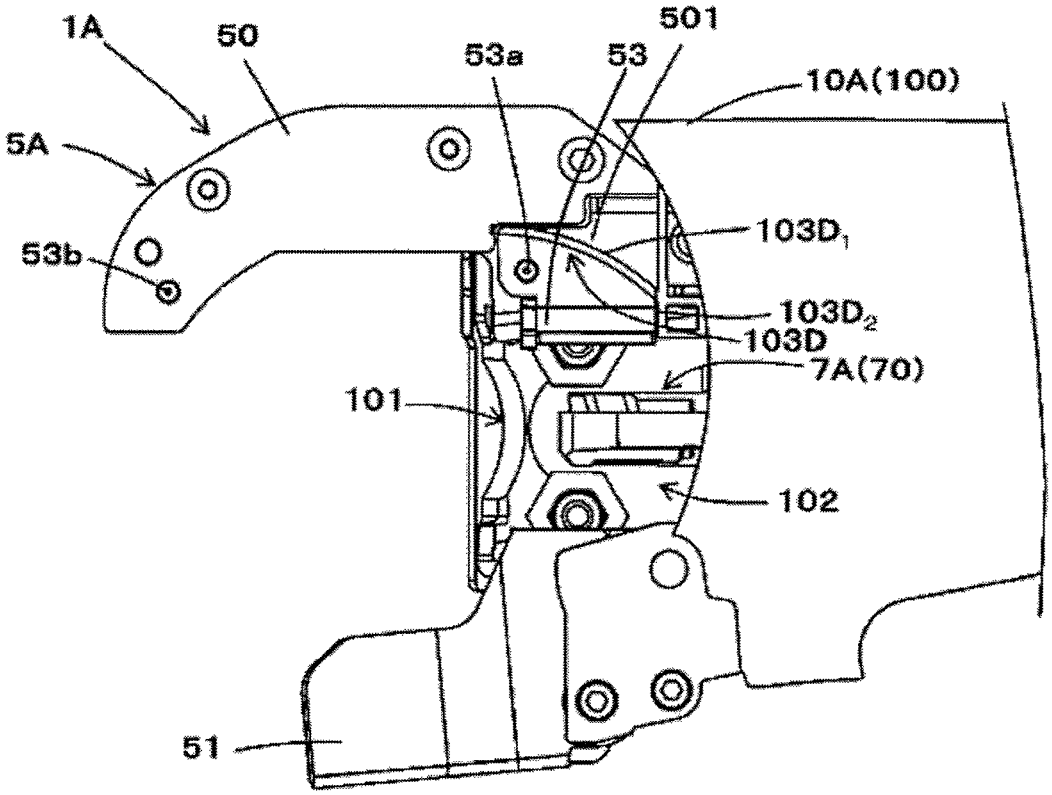
FIG. 18 is a side view depicting an example of a main configuration of a reinforcing bar binding machine in accordance with a modified embodiment of the embodiment.

FIGS. 16 to 18 depict examples of a main configuration of a reinforcing bar binding machine in accordance with modified embodiments of the embodiment. In the below, the other embodiments of the entry regulation convex part are described. An entry regulation convex part 103B shown in FIG. 16 is an example of the entry regulation part, is configured by a convex part provided on the inner surface of the housing 100, and protrudes toward the retraction mechanism 53 of the first guide pin 53*a*.

The entry regulation convex part 103B has a discharge guide part 103$B_1$ that guides the wire W toward the opening portion 101 in the discharge direction when the wire W incapable of being normally fed is contacted thereto, and a rear-entry regulation part 103$B_2$ configured to prevent the wire W incapable of being normally fed from entering into the rear of the operation space 102.

In this example, a surface of the discharge guide part 103$B_1$, to which the wire W is contacted, is configured by a curved inclined surface of which a side closer to the opening portion 101 is inclined in the direction of coming close to the wire feeding unit 3A with respect to the discharge direction of the wires from the operation space 102 toward the opening portion 101, i.e., is inclined in the downstream direction with respect to the feeding direction of the wire W to be fed from the wire feeding unit 3A toward the first guide 50. The rear-entry regulation part 103$B_2$ is configured by a convex part continuing from the discharge guide part 103$B_1$ at the rear of the operation space 102 opposite to the opening portion 101.

An entry regulation convex part 103C shown in FIG. 17 is an example of the entry regulation part, is configured by a convex part provided on the inner surface of the housing 100, and protrudes toward the retraction mechanism 53 of the first guide pin 53*a*.

The entry regulation convex part 103C has a discharge guide part 103$C_1$ that guides the wire W toward the opening portion 101 in the discharge direction when the wire W incapable of being normally fed is contacted thereto, and a rear-entry regulation part 103$C_2$ configured to prevent the wire W incapable of being normally fed from entering into the rear of the operation space 102.

In this example, a surface of the discharge guide part 103$C_1$, to which the wire W is contacted, is configured by a linear surface extending in the front and back direction from the operation space 102 toward the opening portion 101. The rear-entry regulation part 103$C_2$ is configured by a convex part continuing from the discharge guide part 103$C_1$ at the rear of the operation space 102 opposite to the opening portion 101.

An entry regulation convex part 103D shown in FIG. 18 is an example of the entry regulation part, is configured by a convex part provided on the inner surface of the housing 100, and protrudes toward the retraction mechanism 53 of the first guide pin 53*a*.

The entry regulation convex part 103D has a discharge guide part 103$D_1$ that guides the wire W toward the opening portion 101 in the discharge direction when the wire W incapable of being normally fed is contacted thereto, and a rear-entry regulation part 103$D_2$ configured to prevent the wire W incapable of being normally fed from entering into the rear of the operation space 102.

In this example, a surface of the discharge guide part 103$D_1$, to which the wire W is contacted, is configured by a curved inclined surface of which a side closer to the opening portion 101 is inclined in the direction of getting away from the wire feeding unit 3A with respect to the discharge direction of the wires from the operation space 102 toward the opening portion 101, i.e., is inclined in the upstream direction with respect to the feeding direction of the wire W to be fed from the wire feeding unit 3A toward the first guide 50. The rear-entry regulation part 103$D_2$ is configured by a convex part continuing from the discharge guide part 103$D_1$ at the rear of the operation space 102 opposite to the opening portion 101.

In each embodiment, the entry regulation convex part as the entry regulation part is provided to the housing 100. However, a configuration is also possible in which the retraction mechanism 53 is provided with an entry regulation convex part having a length reaching the housing 100 and the housing 100 is provided with a hole portion into which the entry regulation convex part is to enter when the retraction mechanism 53 moves.

1A . . . reinforcing bar binding machine, 10A . . . main body part, 100 . . . housing, 101 . . . opening portion, 102 . . . operation space, 103A, 103B, 103C, 103D . . . entry regulation convex part (entry regulation part), 103$A_1$, 103$B_1$, 103$C_1$, 103$D_1$ . . . discharge guide part, 103$A_2$, 103$B_2$, 103$C_2$, 103$D_2$ . . . rear-entry regulation part, 2A . . . magazine, 20 . . . reel, 3A, 3B, 3C . . . wire feeding unit, 30L . . . first feeding gear (feeding member), 31L . . . tooth part, 32L . . . groove portion, 30R . . . second feeding gear (feeding member), 31R . . . tooth part, 32R . . . groove portion, 33 . . . feeding motor (motor), 33*a* . . . small gear, 33*b* . . . large gear, 34 . . . drive force transmission mechanism, 34*a* . . . feeding small gear, 36 . . . displacement member, 4$A_1$ . . . first wire guide, 4$A_2$ . . . second wire guide, 5A . . . curl guide part, 50 . . . curl guide (first guide), 51 . . . inductive guide (second guide), 53 . . . retraction mechanism, 53*a* . . . first guide pin, 53*b* . . . second guide pin, 6A . . . cutting unit, 60 . . . fixed blade part, 61 . . . moveable blade part, 62 . . . transmission mechanism, 7A . . . binding unit, 70 . . . gripping part, 70C . . . fixed gripping member, 701 . . . introduction guide part, 70L . . . first moveable gripping member, 70R . . . second moveable gripping member, 71 . . . bending part, 71*a* . . . opening and closing pin, 76 . . . shaft, 8A . . . drive unit, 80 . . . motor, 81 . . . decelerator, 82 . . . rotary shaft, 83 . . . moveable member, W . . . wire

The invention claimed is:

1. A binding machine comprising:

a wire feeding unit configured to feed a wire to be wound on an object to be bound;

a binding unit configured to twist the wire wound on the object to be bound;

a first guide having an introduction part into which the wire to be fed by the wire feeding unit is to be introduced, and configured to curl the wire introduced from the introduction part;

a second guide configured to guide the wire delivered from the first guide toward the binding unit;

a main body part having one end portion at which the first guide and the second guide are provided; and an entry regulation part provided in the main body part, provided at one side of the introduction part of the first guide at a downstream side of the binding unit with respect to a feeding direction of the wire to be fed toward the first guide by the wire feeding unit, and configured to prevent the wire from entering into one side of the introduction part of the first guide;

wherein the entry regulation part is a convex part protruding toward the introduction part of the first guide from a part, which is located at one side of the introduction part of the first guide, of an inner surface of a housing configuring an exterior package of the main body part.

2. The binding machine according to claim 1, wherein the entry regulation part has a discharge guide part configured to guide the wire, which is contacted to the entry regulation part, in a discharge direction.

3. The binding machine according to claim 2, wherein the discharge guide part includes an inclined surface of which a tip end-side of the entry regulation part with respect to a wire discharge direction to an outside of the main body part is inclined in a direction toward the wire feeding unit.

4. The binding machine according to claim 2, further comprising:

an opening portion provided at a front end of the main body part and between the first guide and the second guide; and an operation space in which a part of the binding unit operates inside the main body part, wherein the discharge guide part is a surface extending in a direction from the operation space to the opening portion.

5. The binding machine according to claim 1, wherein the first guide comprises a guide member configured to curl the wire, and a retraction mechanism configured to retract the guide member, and the entry regulation part is provided at a position at which the wire is prevented from entering into a moveable area of the retraction mechanism.

6. A binding machine comprising:

a wire feeding unit configured to feed a wire to be wound on an object to be bound;

a binding unit configured to twist the wire wound on the object to be bound;

a first guide having an introduction part into which the wire to be fed by the wire feeding unit is to be introduced, and configured to curl the wire introduced from the introduction part;

a second guide configured to guide the wire delivered from the first guide toward the binding unit;

a main body part having one end portion at which the first guide and the second guide are provided; and an entry regulation part provided in the main body part, provided at one side of the introduction part of the first guide at a downstream side of the binding unit with respect to a feeding direction of the wire to be fed toward the first guide by the wire feeding unit, and configured to prevent the wire from entering into one side of the introduction part of the first guide, wherein:

the first guide comprises a guide member configured to curl the wire, and a retraction mechanism configured to retract the guide member, the entry regulation part is provided at a position at which the wire is prevented from entering into a moveable area of the retraction mechanism, the entry regulation part is a convex part provided to the retraction mechanism, the convex part has a length which reaches a housing configuring an exterior package of the main body part, and the housing is provided with a hole shape portion into which the convex part enters when the retraction mechanism moves.

* * * * *